US012559849B2

(12) United States Patent
Lee et al.

(10) Patent No.: US 12,559,849 B2
(45) Date of Patent: Feb. 24, 2026

(54) WATER SPLITTING CATALYST

(71) Applicants: RESEARCH & BUSINESS FOUNDATION SUNGKYUNKWAN UNIVERSITY, Suwon-si (KR); INSTITUTE FOR BASIC SCIENCE, Daejeon (KR)

(72) Inventors: Hyoyoung Lee, Suwon-si (KR); Jinsun Lee, Suwon-si (KR); Ashwani Kumar, Suwon-si (KR)

(73) Assignees: Research & Business Foundation Sungkyunkwan University, Suwon-si (KR); INSTITUTE FOR BASIC SCIENCE, Daejeon (KR)

( * ) Notice: Subject to any disclaimer, the term of this patent is extended or adjusted under 35 U.S.C. 154(b) by 809 days.

(21) Appl. No.: 17/560,979

(22) Filed: Dec. 23, 2021

(65) Prior Publication Data

US 2022/0205118 A1 Jun. 30, 2022

(30) Foreign Application Priority Data

Dec. 24, 2020 (KR) ..... 10-2020-0183031

(51) Int. Cl.
*C25B 11/073* (2021.01)
*C25B 1/04* (2021.01)
*C25B 11/054* (2021.01)

(52) U.S. Cl.
CPC ..... *C25B 11/073* (2021.01); *C25B 1/04* (2013.01); *C25B 11/054* (2021.01)

(58) Field of Classification Search
CPC ..... C25B 1/04
See application file for complete search history.

(56) References Cited

PUBLICATIONS

Singh et al ("Strategic Preparation of Efficient and Durable NiCo Alloy Supported N-Doped Porous Graphene as an Oxygen Evolution Electrocatalyst: A Theoretical and Experimental Investigation", Adv. Mater. Interfaces, 2016, 3, pp. 1600532 1-14) (Year: 2016).*
Lu et al ("Electrocatalysis of Single-Atom Sites: Impacts of Atomic Coordination", ACS Catal. Jun. 2020, 10, pp. 7584-7618) (Year: 2020).*
Lyons et al ("A comparative study of the oxygen evolution reaction on oxidised nickel, cobalt and iron electrodes in base", Journal of Electroanalytical Chemistry, 641 (2010), p. 119-130 (Year: 2010).*
Perry et al ("The oxygen reduction reaction (ORR) on reduced metals: evidence for a unique relationship between the coverage of adsorbed oxygen species and adsorption energy", Phys. Chem. Chem. Phys., 2016, 18, 10218-10223) (Year: 2016).*
Li et al (N-doped graphene as catalysts for oxygen reduction and oxygen evolution reactions: Theoretical considerations, Journal of Catalysis, 314 (2014), pp. 66-72). (Year: 2014).*
(Continued)

*Primary Examiner* — Alexander W Keeling
(74) *Attorney, Agent, or Firm* — NSIP Law

(57) ABSTRACT

The present disclosure relates to a water splitting catalyst including a porous carbon layer, a bimetallic metal alloy core dispersed on the porous carbon layer, and a single-atom precious metal dispersed on the bimetallic metal alloy core, in which oxygen is adsorbed on the surface of the bimetallic metal alloy core.

17 Claims, 26 Drawing Sheets

(56) References Cited

PUBLICATIONS

Wu et al ("High-throughput chainmail catalyst FeCo@C nanoparticle for oxygen evolution reaction", International Journal of Hydrogen Energy, Jul. 2020, 45, pp. 26574-26582). (Year: 2020).*
Yang et al ("Single-Atom Catalysts: A New Frontier in Heterogeneous Catalysis", Accounts of Chemical Research, 1740-1748, 2013, vol. 46, No. 8) (Year: 2013).*
Wang et al ("Nanocrystal supracrystal-derived atomically dispersed Mn—Fe catalysts with enhanced oxygen reduction activity", Nano Energy, 63, 2019, 103851, pp. 1-10) (Year: 2019).*
Zhu et al ("Single-Atom Catalysts for Electrochemical Water Splitting", ACS Energy Lett. 2018, 3, 1713-1721) (Year: 2018).*
Cao et al ("Dynamic oxygen adsorption on single-atomic Ruthenium catalyst with high performance for acidic oxygen evolution reaction", Nat Commun 10, 4849 (2019) (Year: 2019).*
Pu, Zonghua et al. "Single-Atom Catalysts for Electrochemical Hydrogen Evolution Reaction: Recent Advances and Future Perspectives" *Shanghai Jiao Tong University Press Nano-Micro Letters Review ISSN2311-6706 e-ISSN 2150-5551 CN 31-2103/TB* vol. 12 Article Jan. 12, 13, 2020 (29 pages in English).

* cited by examiner

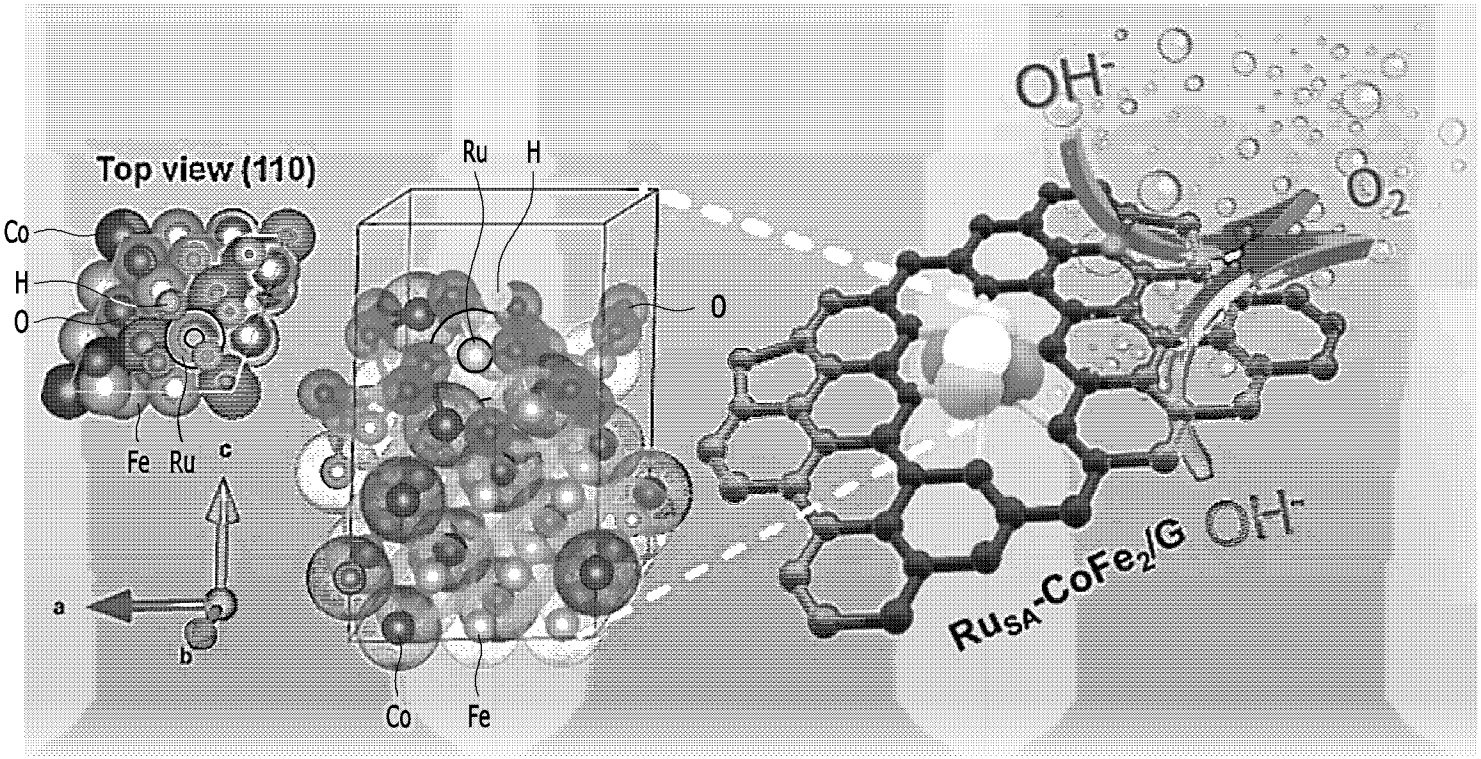
[FIG. 1]

[FIG. 2]
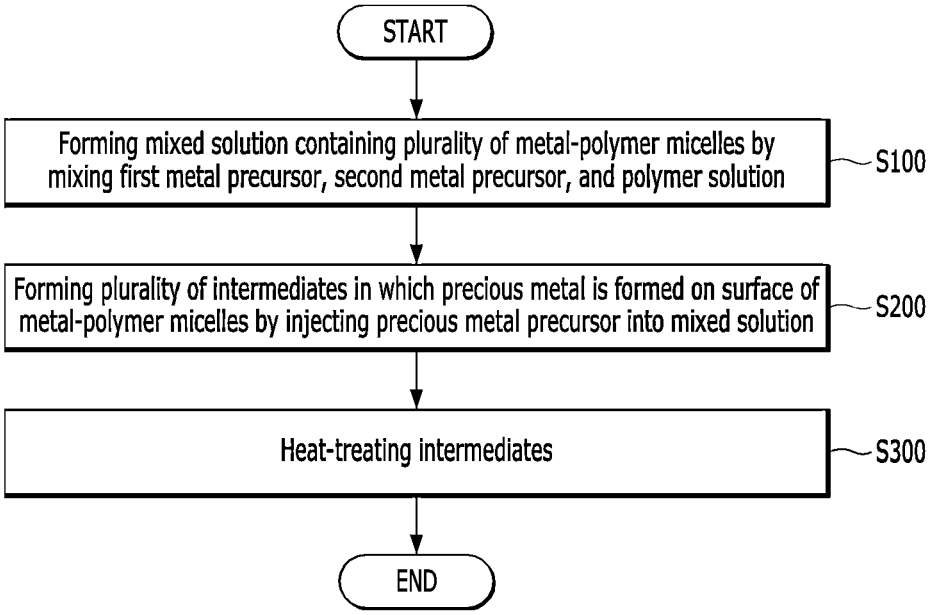

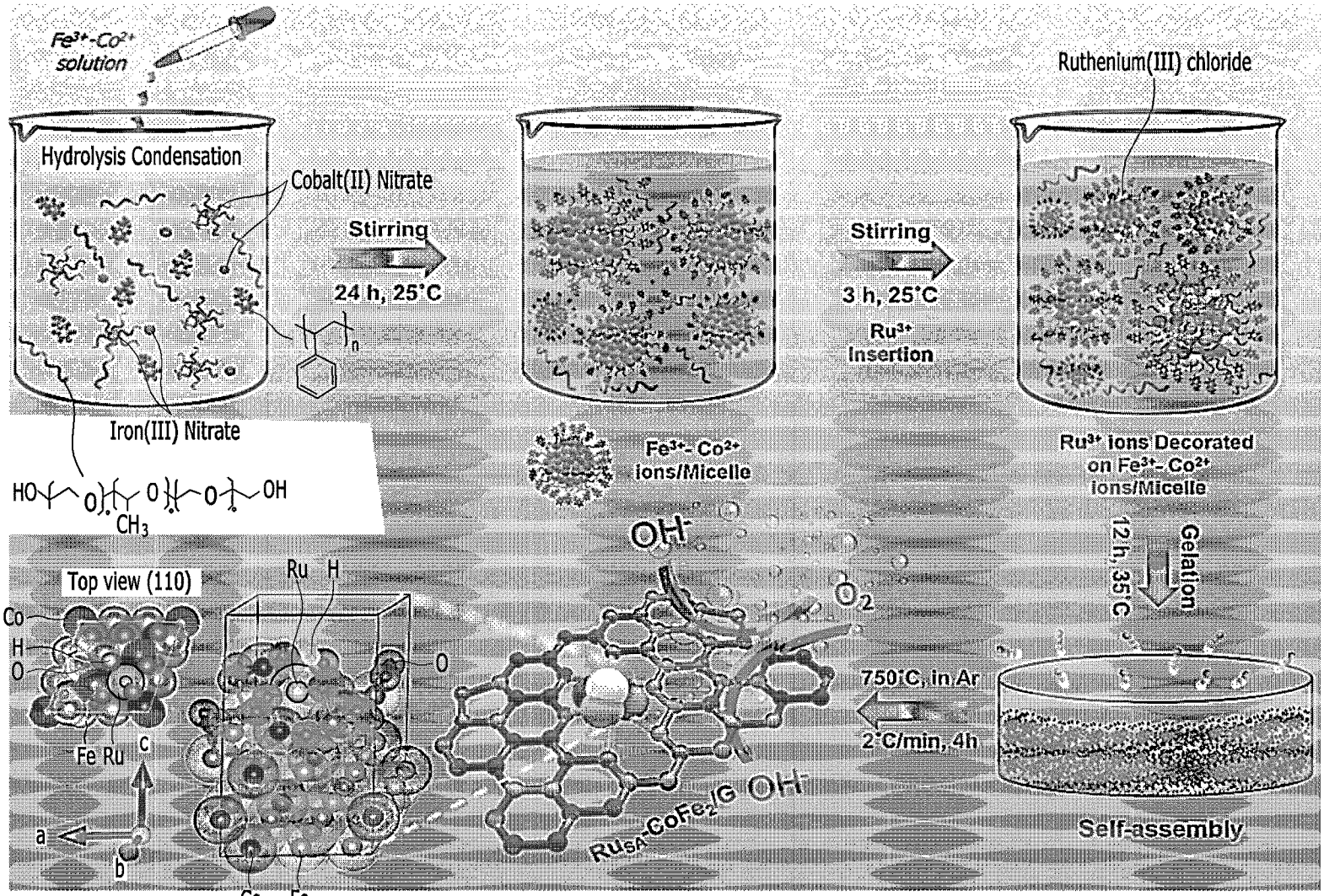
[FIG. 3]

[FIG. 4]
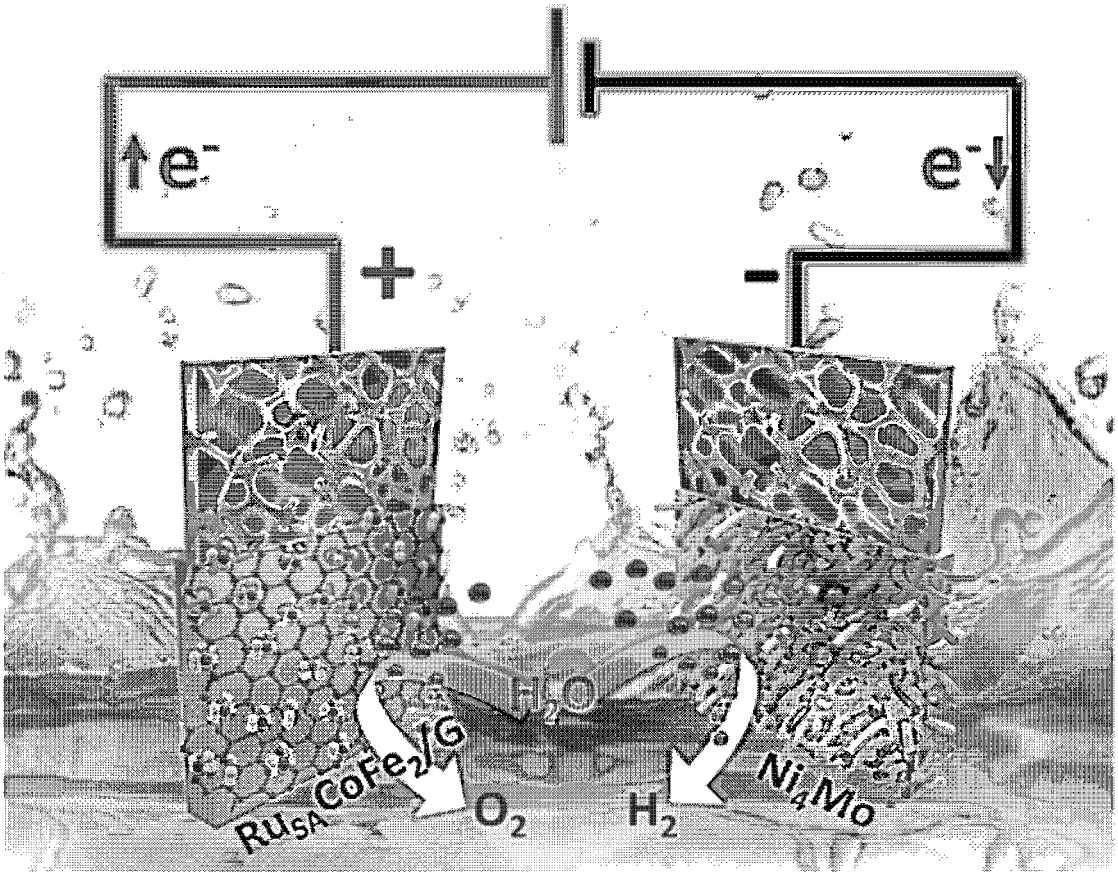

[FIG. 5]
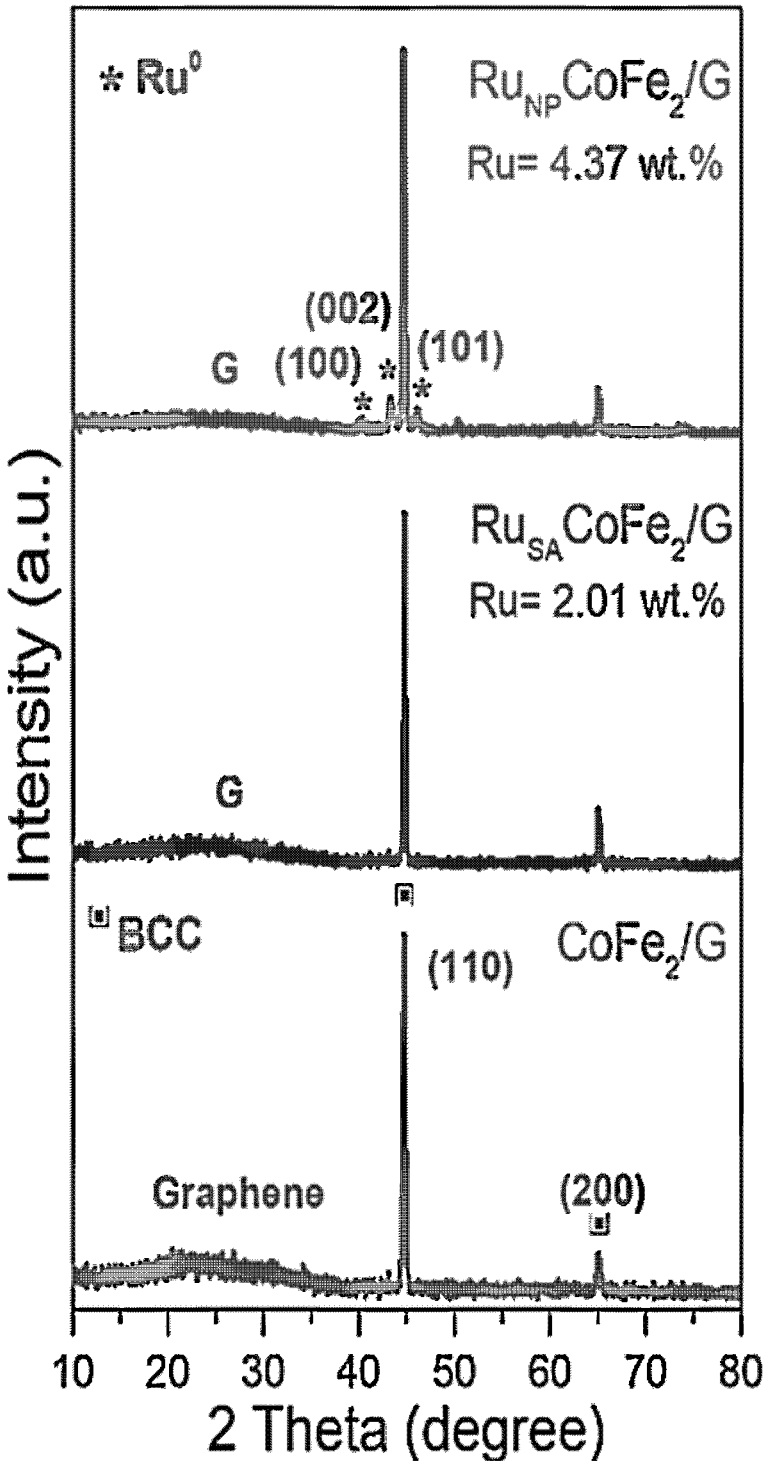

[FIG. 6A]
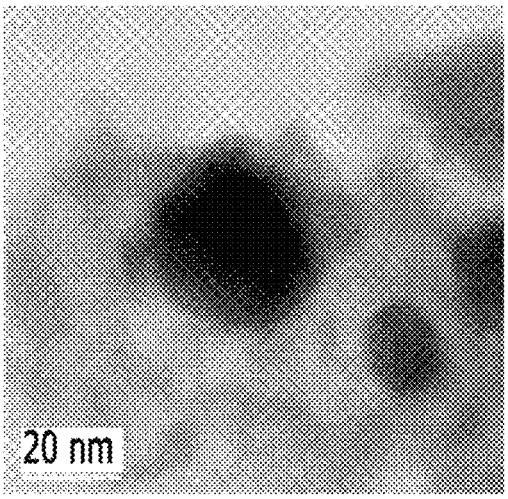
[FIG. 6B]
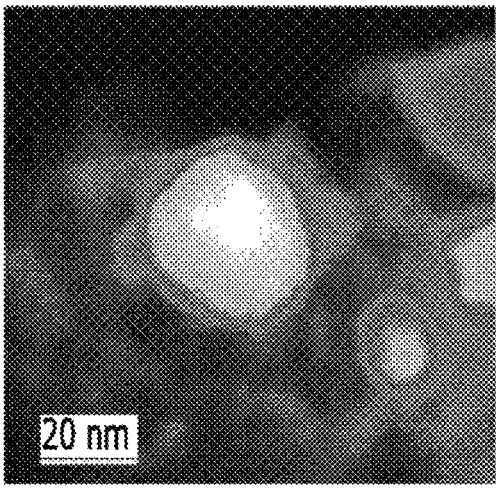
[FIG. 6C]
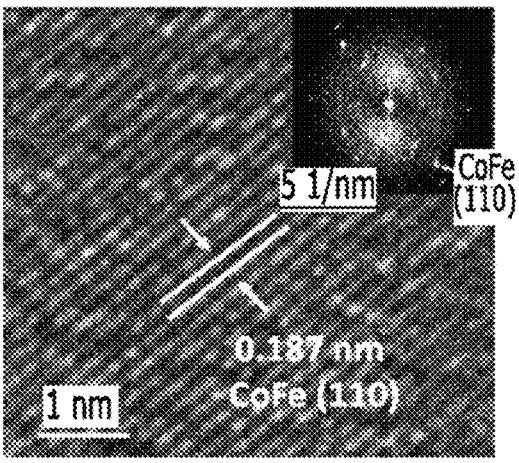

[FIG. 6D]
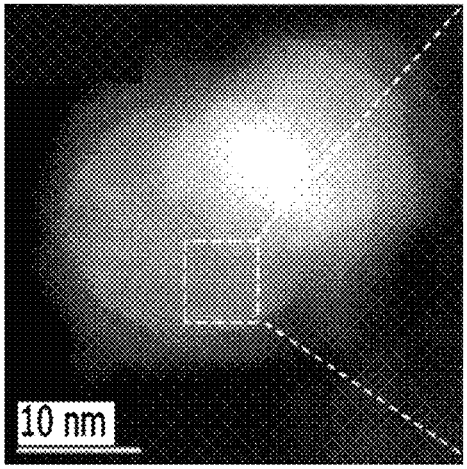
[FIG. 6E]
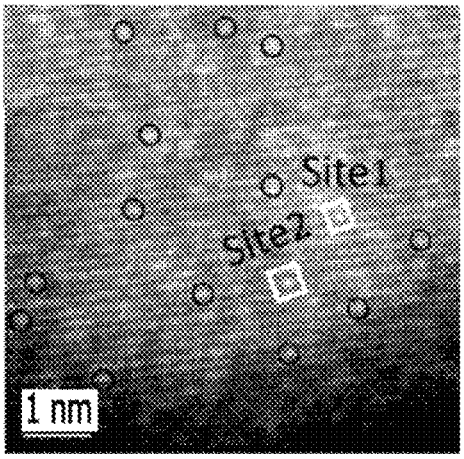
[FIG. 6F]
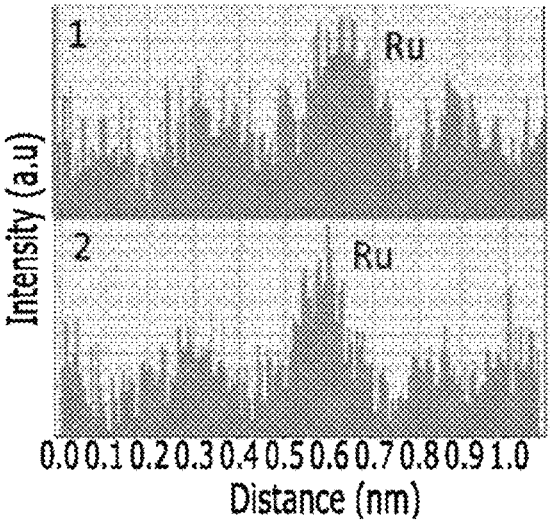

[FIG. 7]
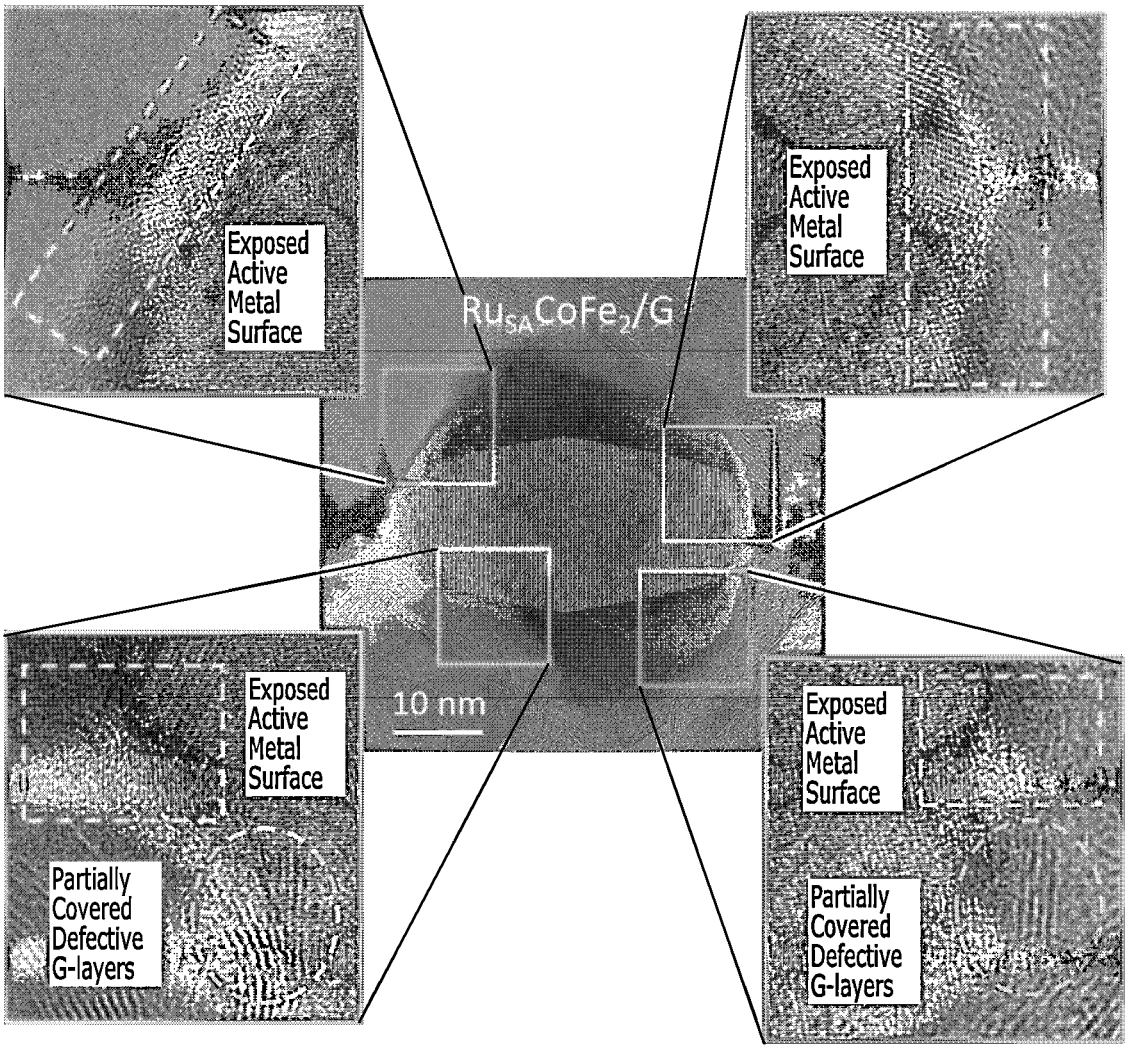

[FIG. 8]
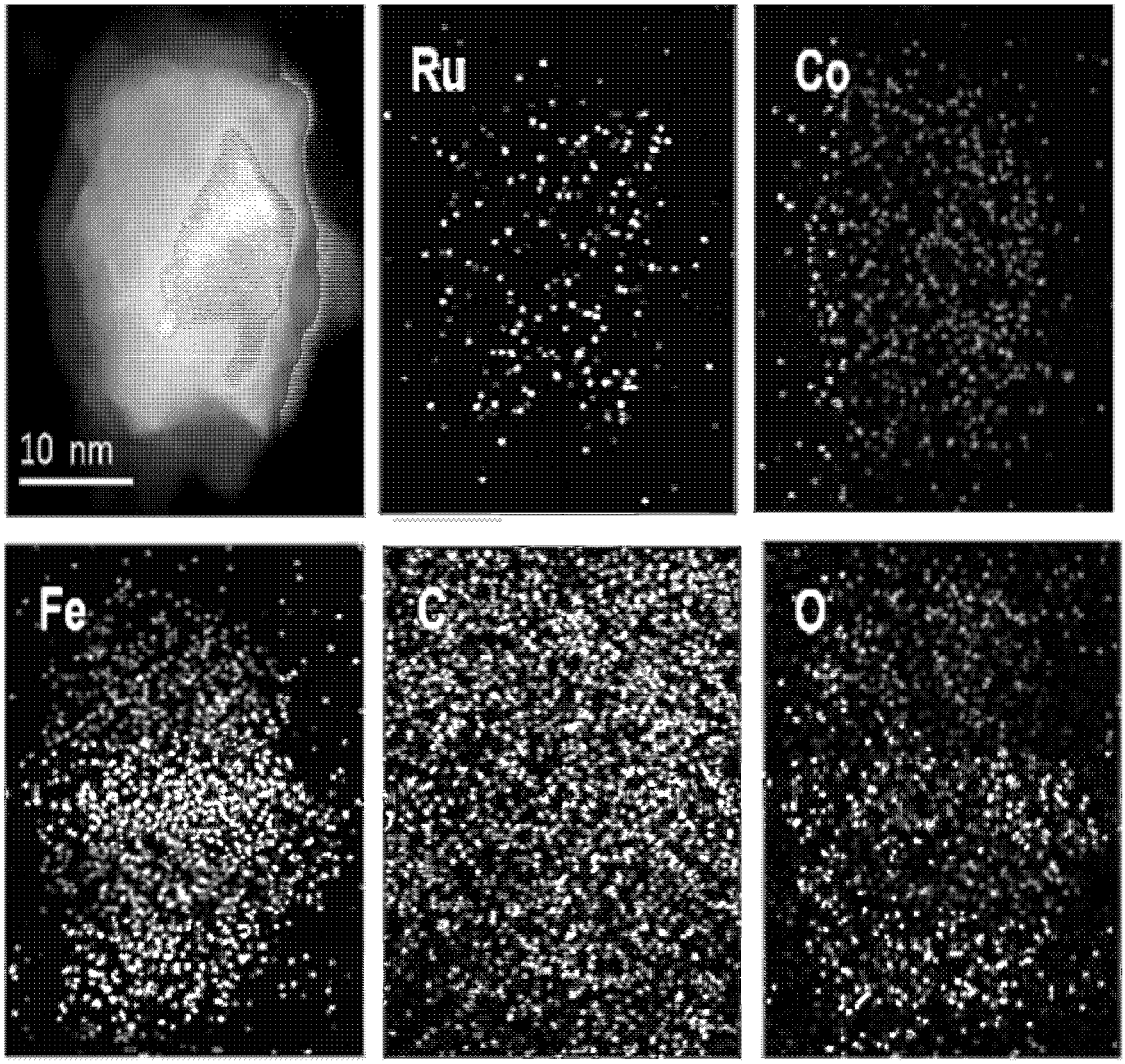

[FIG. 9A]
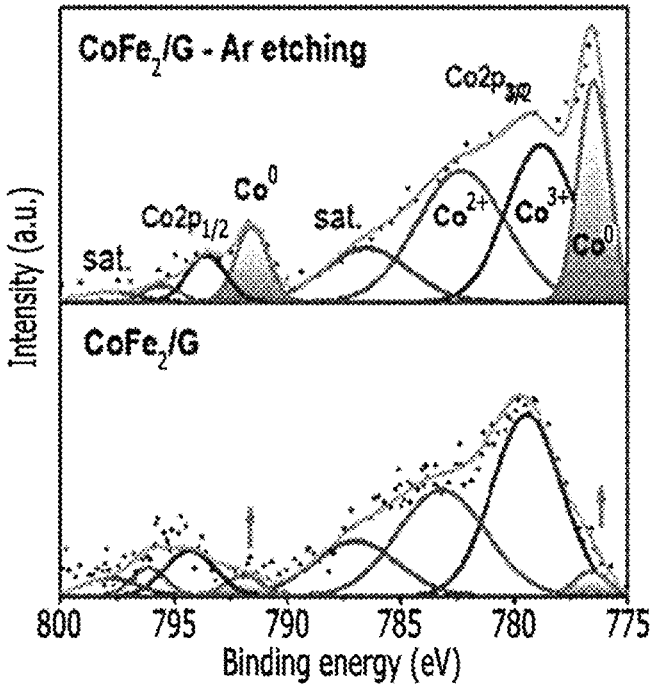
[FIG. 9B]
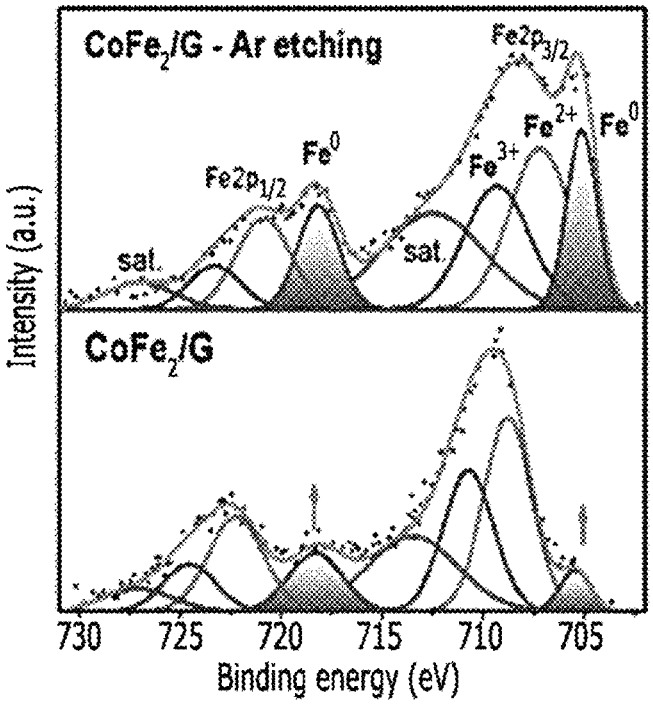

[FIG. 9C]
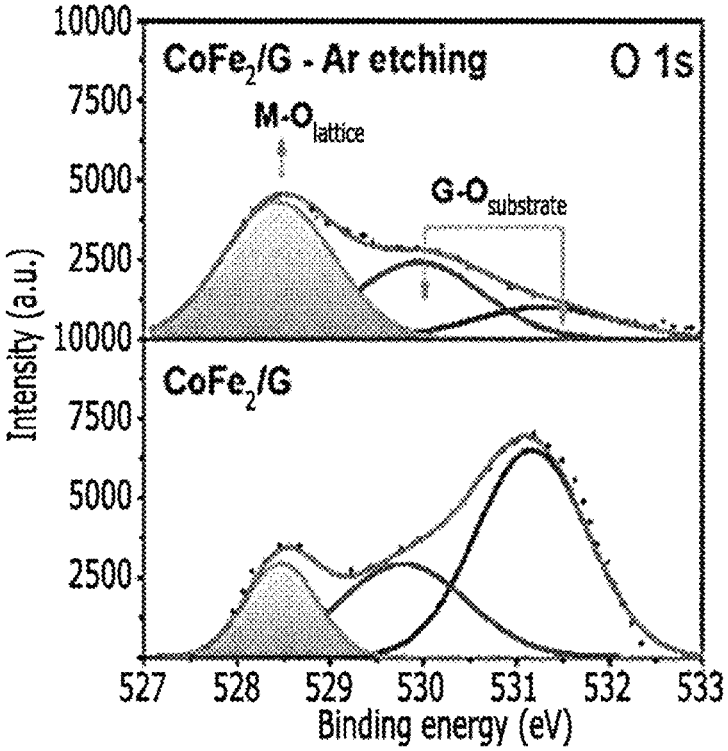

[FIG. 10A]
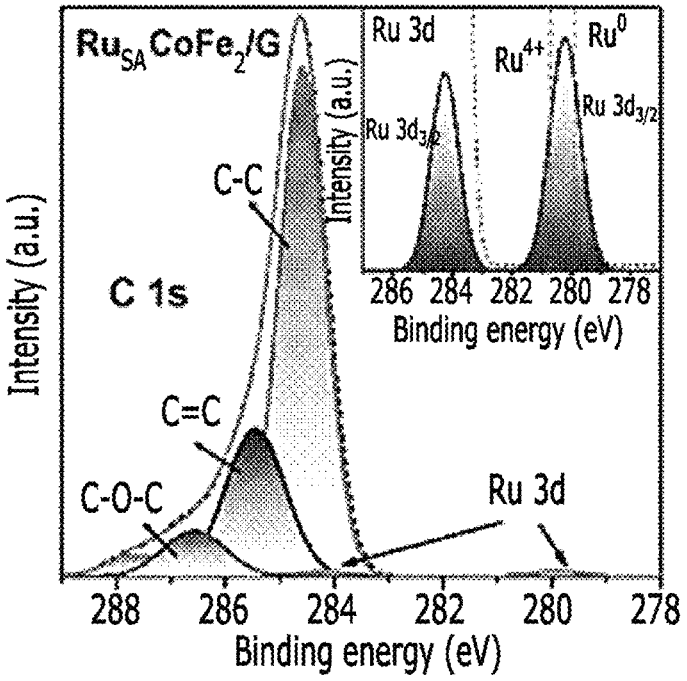
[FIG. 10B]
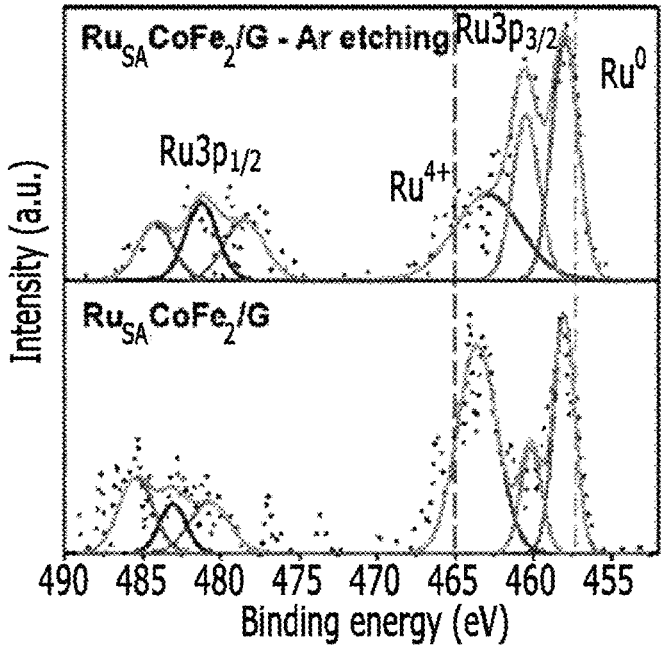

[FIG. 10C]
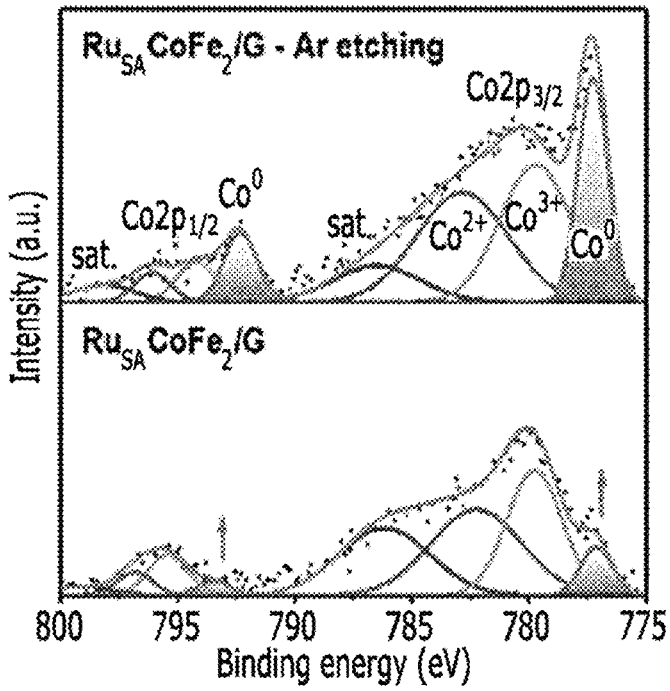
[FIG. 10D]
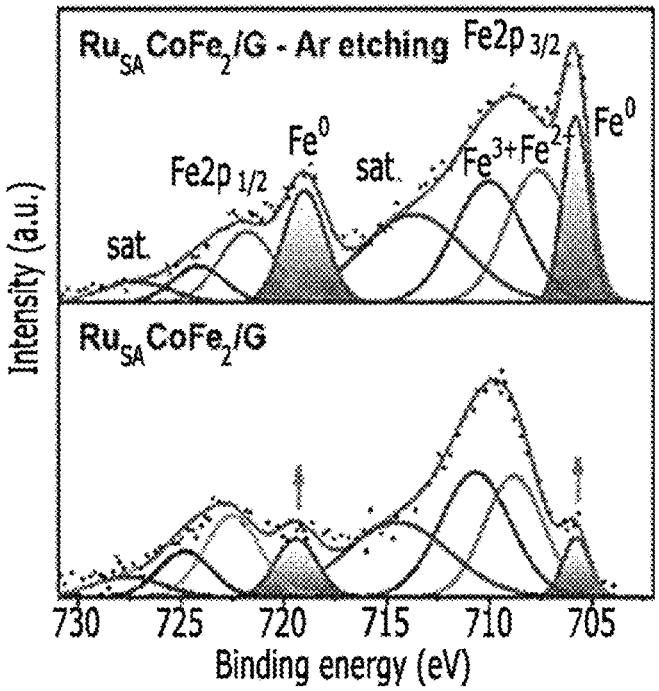

[FIG. 10E]
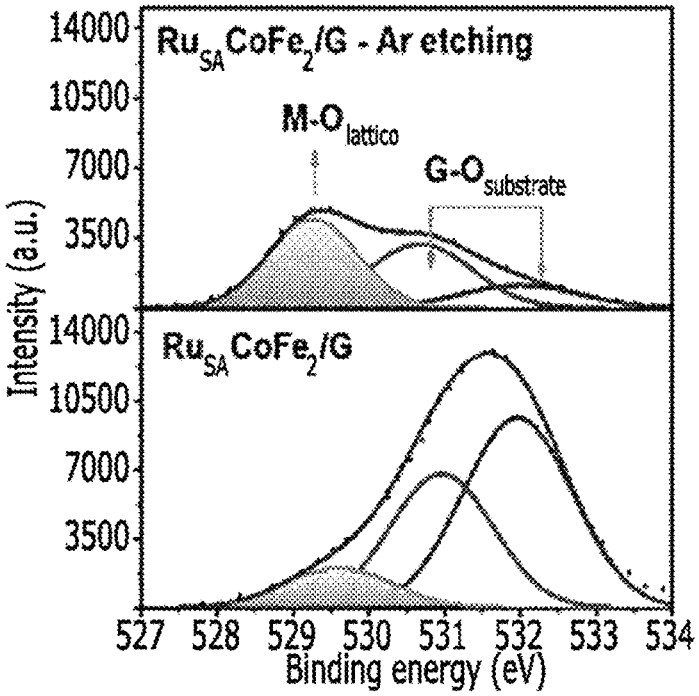

[FIG. 11A]
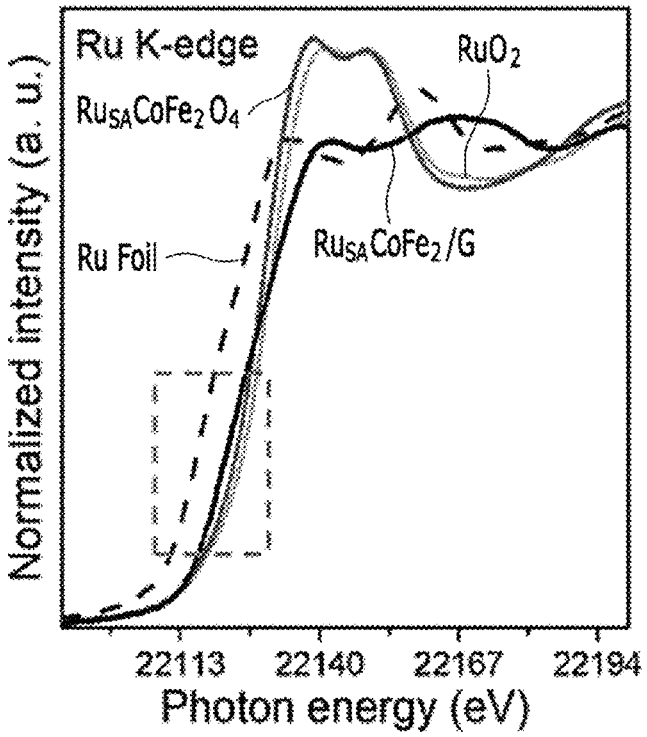
[FIG. 11B]
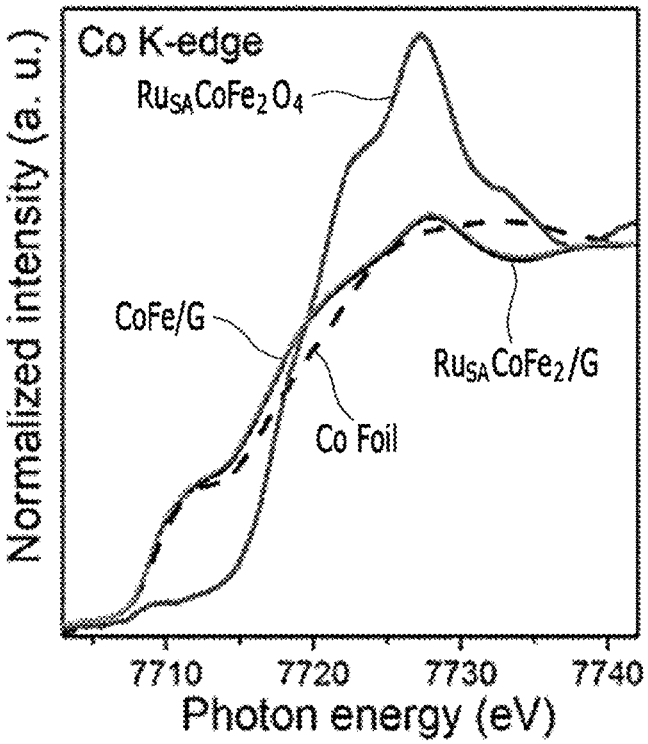

[FIG. 11C]
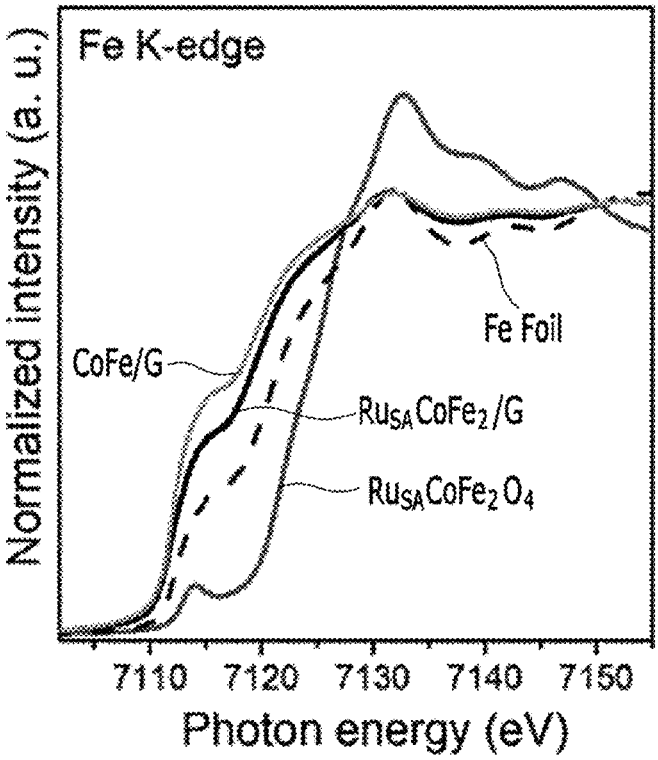

[FIG. 12A]
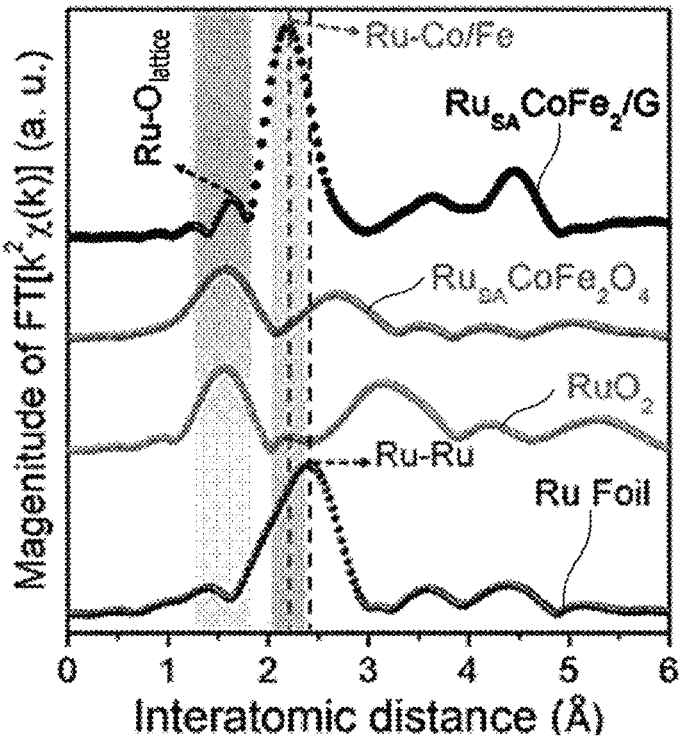
[FIG. 12B]
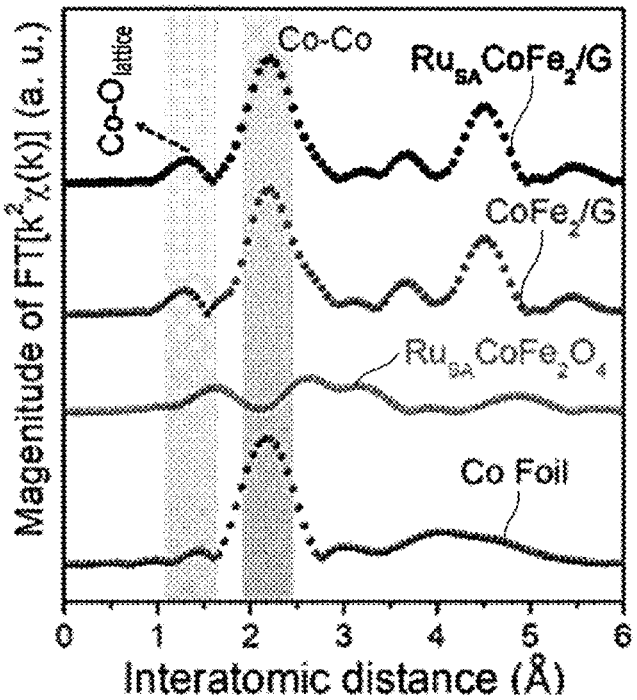

[FIG. 12C]
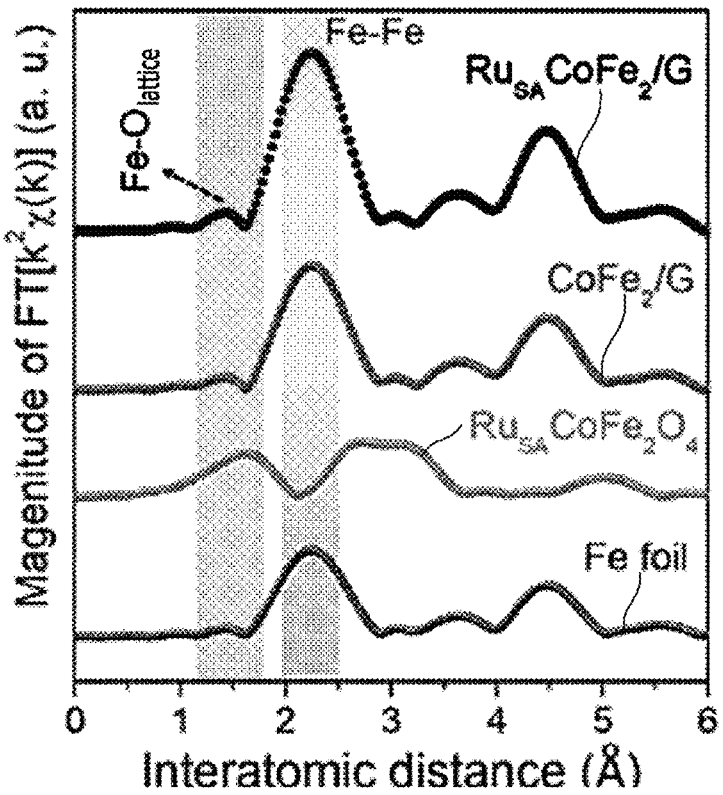

[FIG. 13]
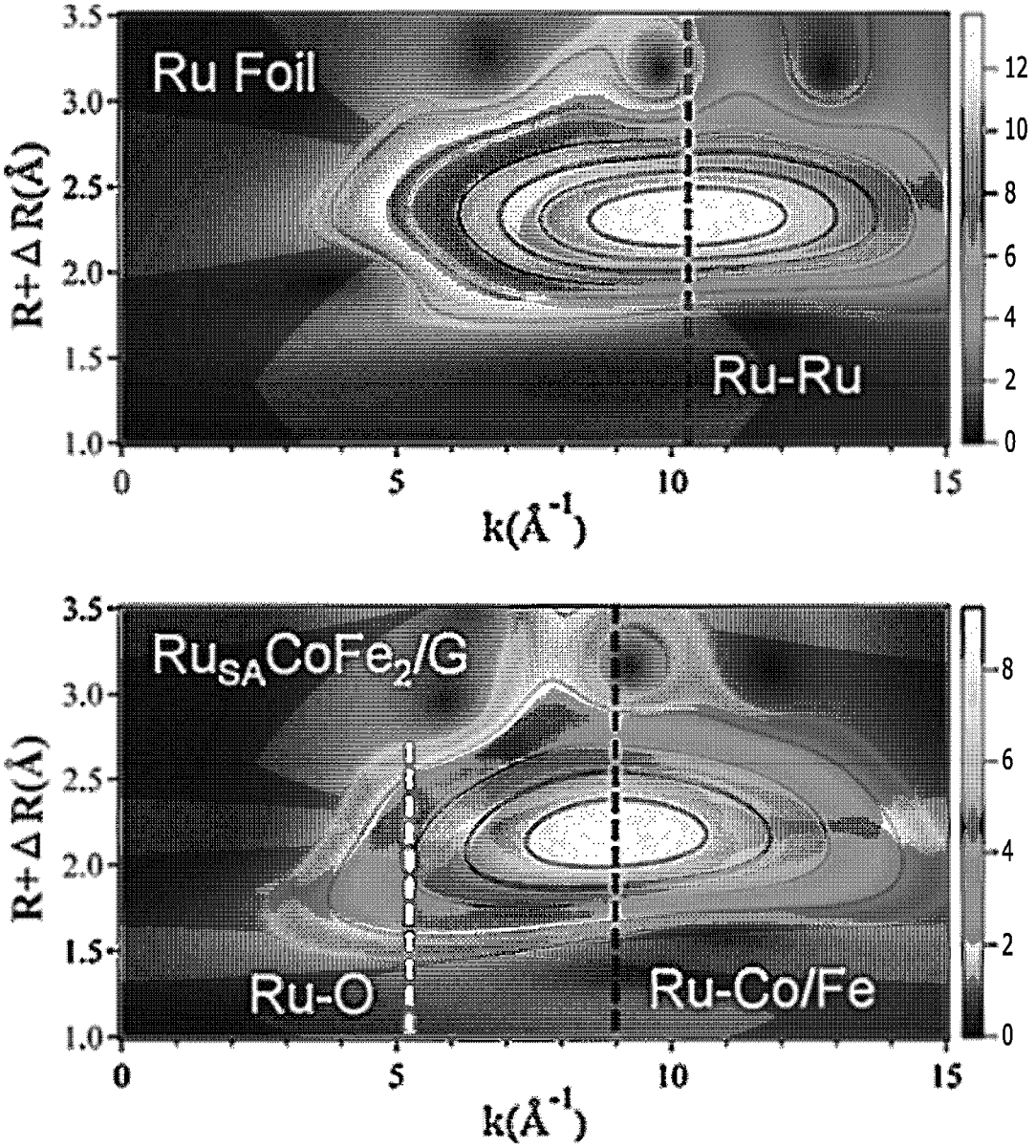

[FIG. 14]
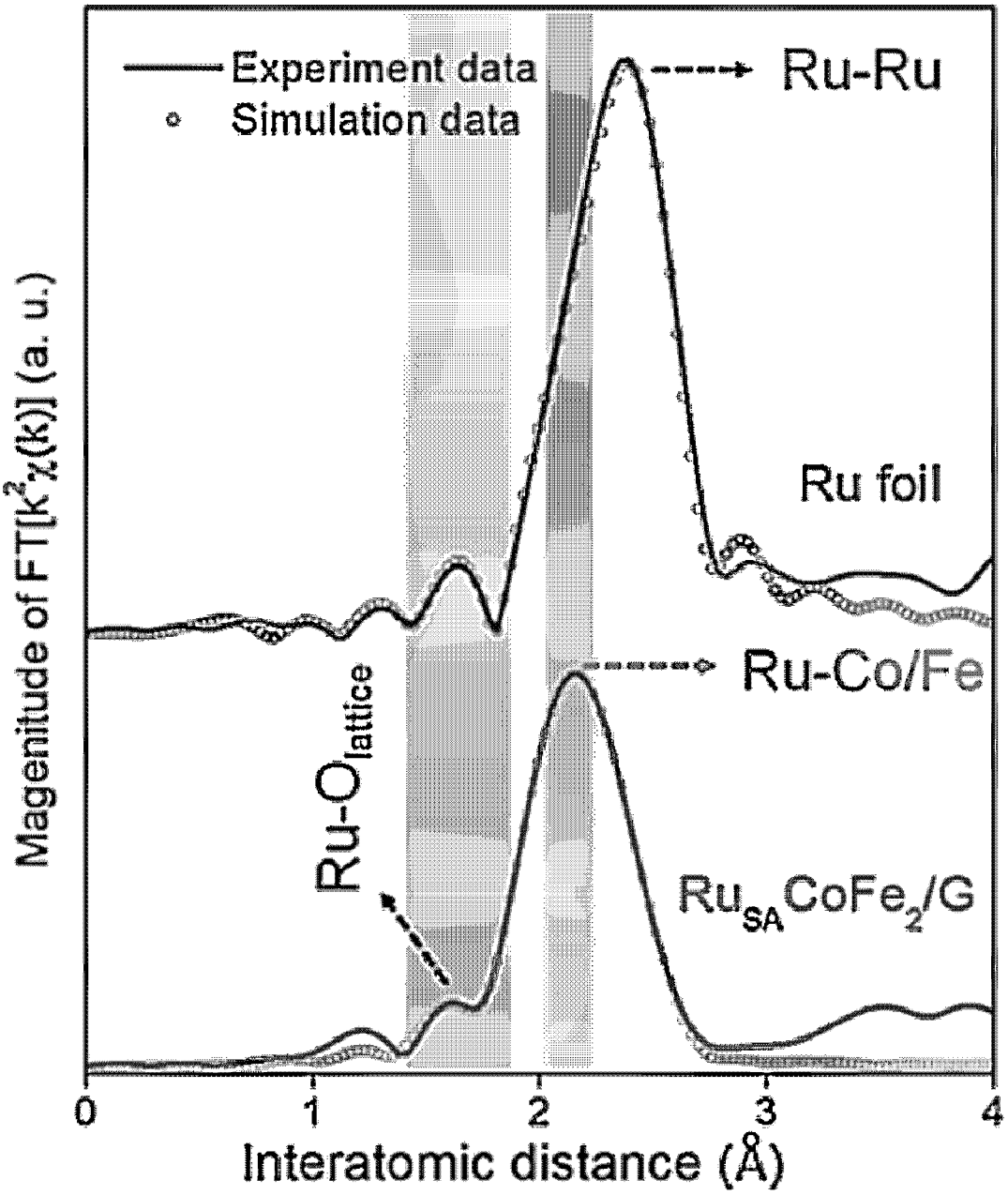

[FIG. 15A]
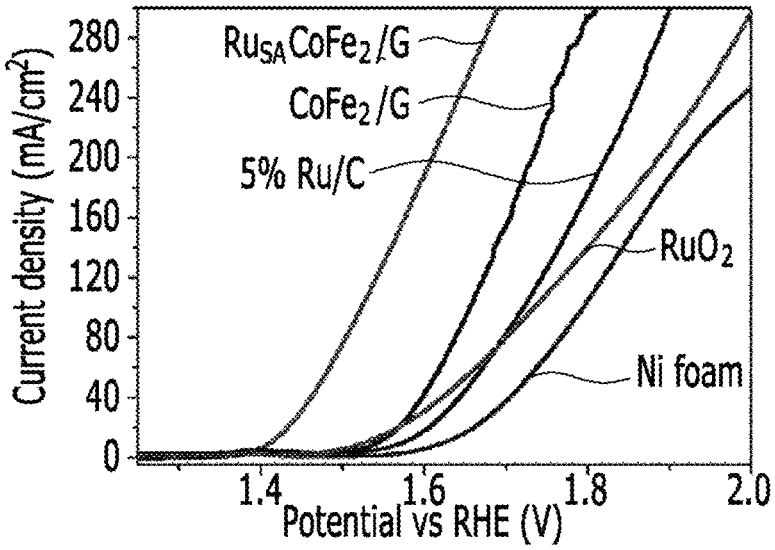
[FIG. 15B]
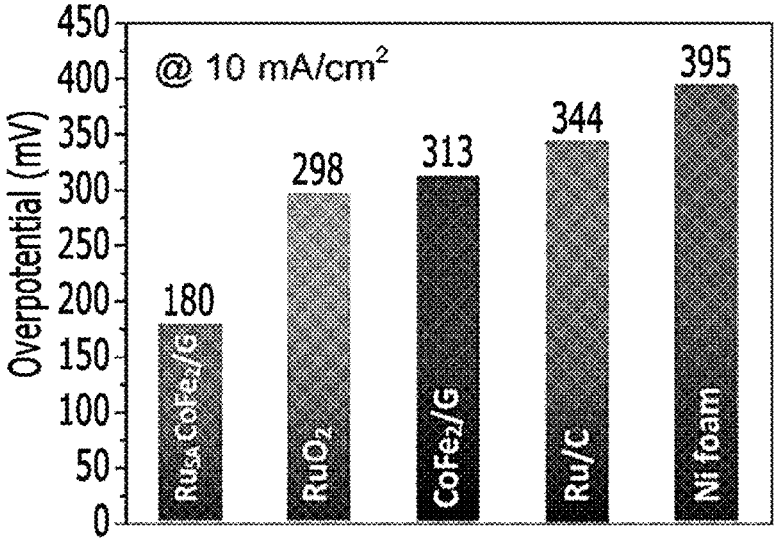

[FIG. 15C]
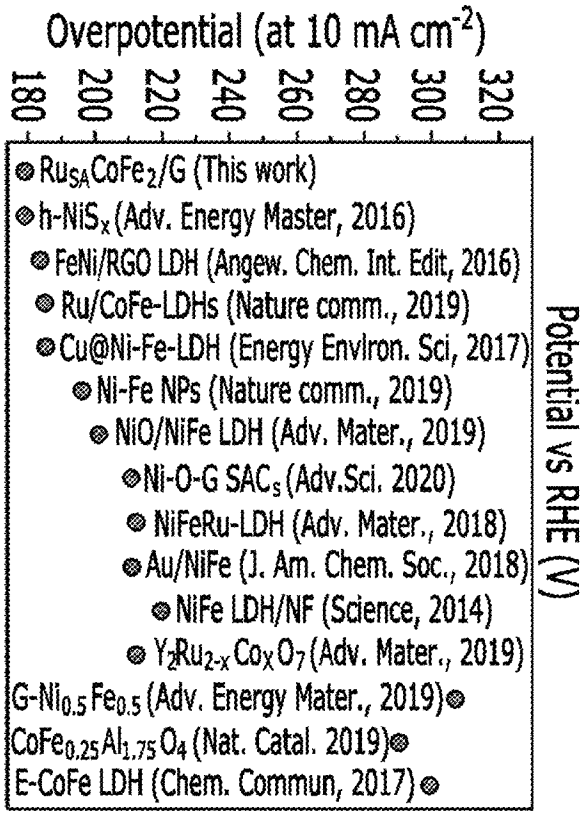
[FIG. 15D]
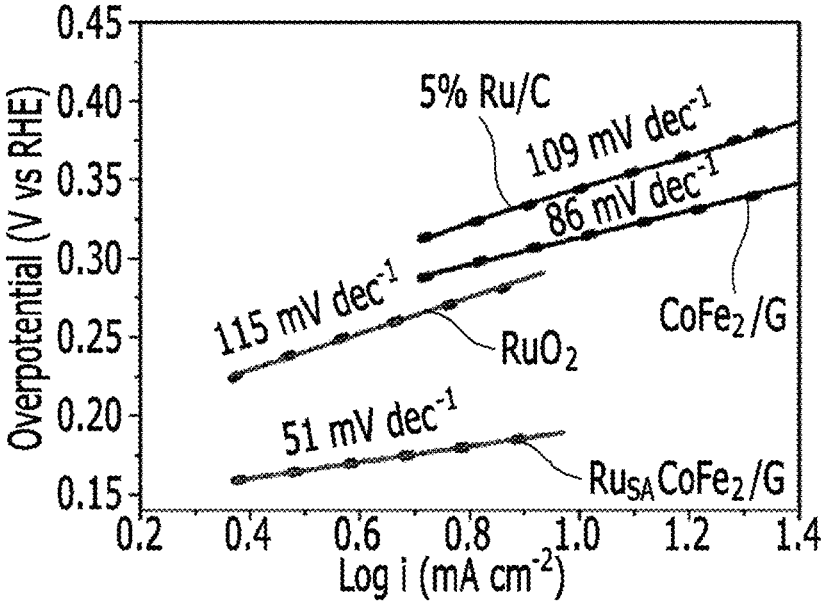

[FIG. 15E]
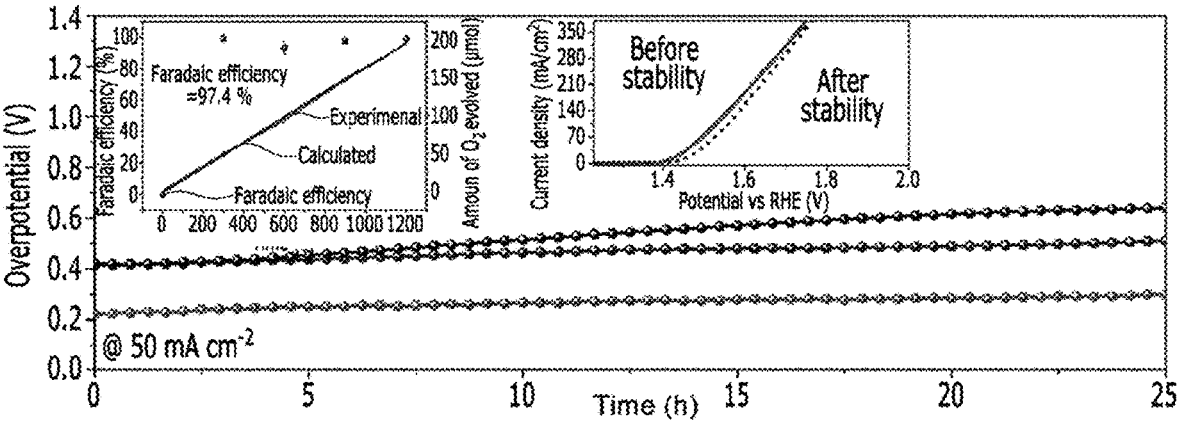

[FIG. 16A]
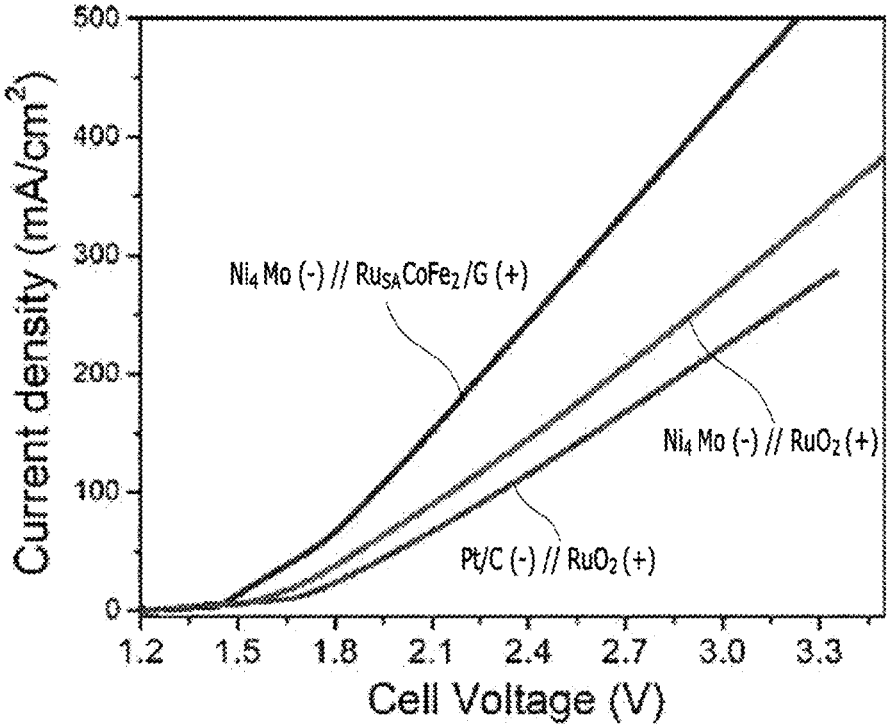
[FIG. 16B]
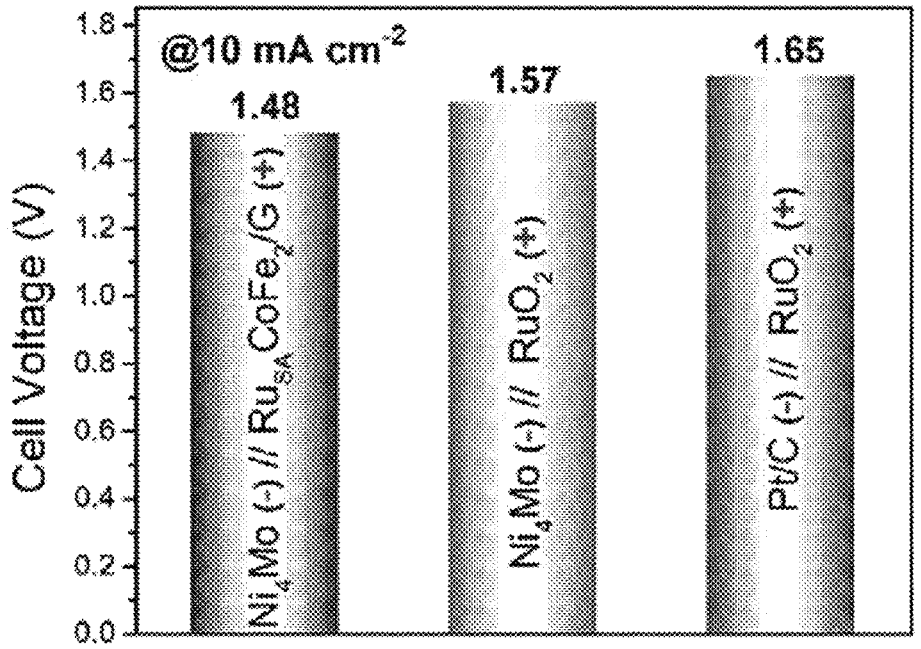

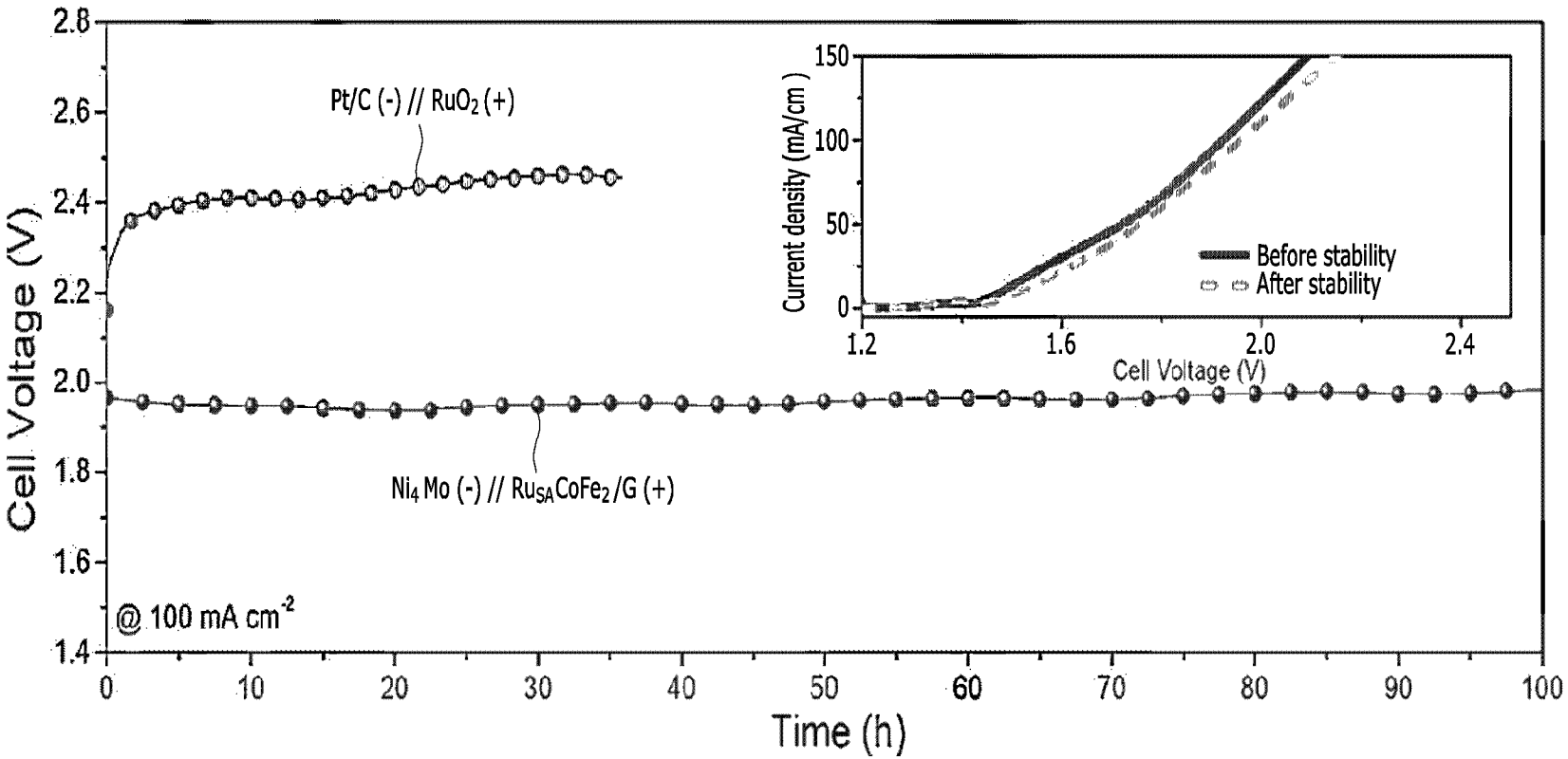
[FIG. 17]

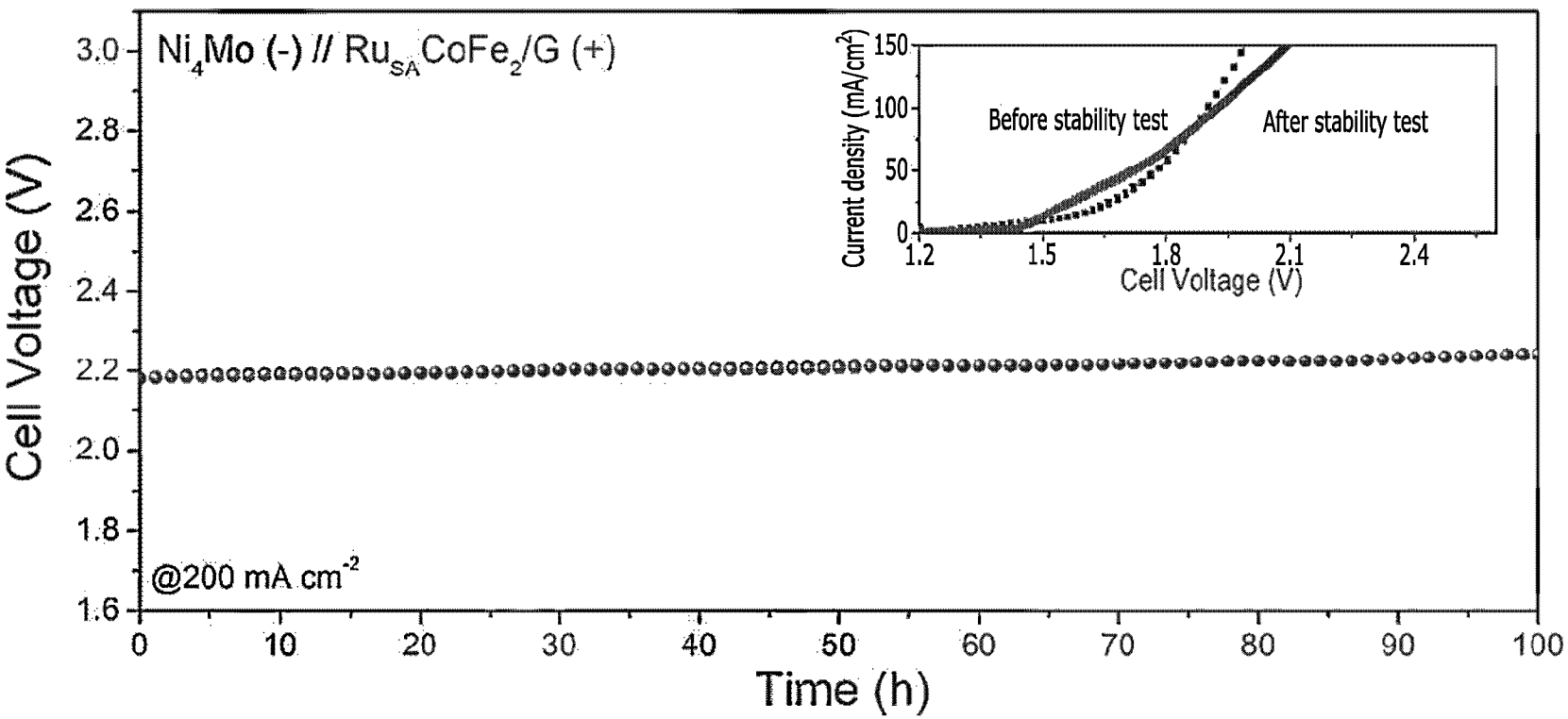
[FIG. 18]

WATER SPLITTING CATALYST

CROSS-REFERENCE TO RELATED APPLICATIONS

This application claims the benefit under 35 U.S.C. § 119(a) of Korean Patent Application No. 10-2020-0183031 filed on Dec. 24, 2020, in the Korean Intellectual Property Office, the entire disclosure of which is incorporated herein by reference for all purposes.

BACKGROUND

1. Field

The present disclosure relates to a water splitting catalyst.

2. Description of the Related Art

A reaction forming hydrogen and oxygen by splitting water does not generate carbon dioxide, etc., unlike thermal power generation and is gaining attention as an eco-friendly energy source generation method, since it does not generate radioactive waste unlike nuclear power generation. However, an oxygen evolution reaction (OER) in the water splitting reaction consumes a lot of energy or requires a long-time such that it has been an obstacle to commercialization of water electrolysis.

The water splitting reaction has been carried out through a Pt-based cathode and a $RuO_2$ or $IrO_2$ anode, but the $RuO_2$ or $IrO_2$ anode that produces oxygen requires use of precious metals, so that expensive materials are required, and the possibility of cross-contamination may exist. Although attention has been paid to single-atom catalysts (SACs) in order to reduce the use of expensive precious metals, problems such as easy exfoliation of the single-atom catalysts due to weak interactions between atoms and a support, occurrence of a problem that single atoms are agglomerated with each other, etc., have been occurred.

The paper Z. Pu, I. S. Amiinu, R. Cheng, P. Wang, C. Zhang, S. Mu, W. Zhao, F. Su, G. Zhang, S. Liao, S. Sun, "Single-Atom Catalysts for Electrochemical Hydrogen Evolution Reaction: Recent Advances and Future Perspectives," *Nano-Micro Lett.* (2020) 12:21, pp. 1-29, which is a background art of the present disclosure, relates to a single-atom catalyst, which can be used in an electrochemical hydrogen evolution reaction. However, the above-mentioned paper does not disclose a single-atom catalyst, which can be used in the OER.

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

In one general aspect, the present disclosure provides a water splitting catalyst including a porous carbon layer, a bimetallic metal alloy core dispersed on the porous carbon layer, and a single-atom precious metal dispersed on the bimetallic metal alloy core, in which oxygen is adsorbed on the surface of the bimetallic metal alloy core.

According to an embodiment of the present disclosure, the oxygen adsorbed on the surface of the bimetallic metal alloy core may stabilize an intermediate material of a water splitting reaction, but the present disclosure is not limited thereto.

According to an embodiment of the present disclosure, the water splitting catalyst may further include an additional oxygen disposed on a surface of the porous carbon layer, but the present disclosure is not limited thereto.

According to an embodiment of the present disclosure, the porous carbon layer may include graphene having defects, but the present disclosure is not limited thereto.

According to an embodiment of the present disclosure, two metals included in the bimetallic metal alloy core may have an atomic composition ratio of 0.25:1 to 4:1, but the present disclosure is not limited thereto.

According to an embodiment of the present disclosure, the bimetallic metal alloy core may include two metal elements selected from the group consisting of Fe, Co, Cu, Zn, Ni, Mn, Cr, Ti, Y, Zr, Nb, and Mo, but the present disclosure is not limited thereto.

According to an embodiment of the present disclosure, the precious metal may be selected from the group consisting of Ru, Ir, Rh, Pd, Ag, Au, Pt, and combinations thereof, but the present disclosure is not limited thereto.

According to an embodiment of the present disclosure, the water splitting catalyst may include 0.01 to 0.8 atomic parts of the single-atom precious metal based on 100 atomic parts of the water splitting catalyst.

According to an embodiment of the present disclosure, the water splitting catalyst may include 1 to 7 atomic parts of the oxygen adsorbed on the surface of the bimetallic metal alloy core based on 100 atomic parts of the water splitting catalyst.

According to an embodiment of the present disclosure, the water splitting catalyst may include 1 to 20 atomic parts of the additional oxygen disposed on the surface of the porous carbon layer based on 100 atomic parts of the water splitting catalyst.

According to an embodiment of the present disclosure, the water splitting catalyst may require an overpotential of 100 to 250 mV to achieve a current density of 10 $mA/cm^2$.

According to an embodiment of the present disclosure, the water splitting catalyst may have a Tafel slope of 40 to 70 mV/dec.

In another general aspect, the present disclosure provides a method for preparing a water splitting catalyst including forming a mixed solution including a metal-polymer micelle ($M_1M_2$-micelles) by mixing a first metal precursor, a second metal precursor, and a polymer solution; forming an intermediate, in which a precious metal is disposed on a surface of the metal-polymer micelle by injecting a precious metal precursor into the mixed solution; and heat-treating the intermediate.

According to an embodiment of the present disclosure, the method may further include self-assembling the intermediate before the heat-treating, but the present disclosure is not limited thereto.

According to an embodiment of the present disclosure, the metal-polymer micelle may include a bimetallic metal alloy core including two metal elements and a polymer dispersed on a surface of the bimetallic metal alloy core, but the present disclosure is not limited thereto.

According to an embodiment of the present disclosure, in the heat-treating, the polymer of the intermediate may form a porous carbon layer, but the present disclosure is not limited thereto.

According to an embodiment of the present disclosure, the polymer solution may include a polymer selected from the group consisting of polystyrene (PS), polyethylene glycol (PEG), polypropylene glycol (PPG), polylactic acid (PLA), and combinations thereof, but the present disclosure is not limited thereto.

According to an embodiment of the present disclosure, the polymer solution may have a pH of 8 to 11, but the present disclosure is not limited thereto.

In still another general aspect, the present disclosure provides a water splitting system including the water splitting catalyst according to the first aspect.

According to an embodiment of the present disclosure, the water splitting catalyst may be a catalyst for an oxygen evolution reaction or a hydrogen evolution reaction, but the present disclosure is not limited thereto.

Other features and aspects will be apparent from the following detailed description, the drawings, and the claims.

BRIEF DESCRIPTION OF THE DRAWINGS

FIG. 1 is a schematic diagram of a water splitting catalyst according to an embodiment of the present disclosure.

FIG. 2 is a flowchart illustrating a method for preparing a water splitting catalyst according to an embodiment of the present disclosure.

FIG. 3 is a schematic diagram showing a method for preparing a water splitting catalyst according to an embodiment of the present disclosure.

FIG. 4 is a schematic diagram of a water splitting system according to an embodiment of the present disclosure.

FIG. 5 is an X-ray diffraction (XRD) graph of a water splitting catalyst according to an example of the present disclosure.

FIGS. 6A to 6C are transmission electron microscope (TEM) images of a water splitting catalyst according to an example of the present disclosure, FIGS. 6D and 6E are high-angle annular dark-field scanning transmission electron microscopy (HAADF-STEM) images, and FIG. 6F is the profiles of the line scan intensities for sites 1 and 2 of FIG. 6E.

FIG. 7 is TEM images of a water splitting catalyst according to an example of the present disclosure.

FIG. 8 is scanning electron microscopy with energy-dispersive X-ray spectroscopy (SEM-EDX) elemental analysis images of a water splitting catalyst according to an example of the present disclosure.

FIGS. 9A to 9C are X-ray photoelectron spectroscopy (XPS) spectra of water splitting catalysts according to an example and a comparative example of the present disclosure.

FIGS. 10A to 10E are XPS spectra of water splitting catalysts according to an example and a comparative example of the present disclosure.

FIGS. 11A to 11C are X-ray absorption near edge structure (XANES) spectra of water splitting catalysts according to an example and a comparative example of the present disclosure.

FIGS. 12A to 12C are extended X-ray absorption fine structure (EXAFS) spectra of water splitting catalysts according to an example and a comparative example of the present disclosure.

FIG. 13 is wavelet transform of extended X-ray absorption fine structure (WT-EXAFS) images of a water splitting catalyst according to an example of the present disclosure.

FIG. 14 is EXAFS fitting curves of water splitting catalysts according to an example and a comparative example of the present disclosure.

FIGS. 15A to 15E are graphs for the oxygen evolution reactions of water splitting catalysts according to an example and a comparative example of the present disclosure.

FIGS. 16A and 16B are graphs showing the water splitting capacities of water splitting catalysts according to an example and a comparative example of the present disclosure.

FIG. 17 is a graph showing the durabilities of water splitting systems according to an example and a comparative example of the present disclosure.

FIG. 18 is a graph showing the durability of a water splitting system according to an example of the present disclosure.

Throughout the drawings and the detailed description, the same reference numerals refer to the same elements. The drawings may not be to scale, and the relative size, proportions, and depiction of elements in the drawings may be exaggerated for clarity, illustration, and convenience.

DETAILED DESCRIPTION OF THE EMBODIMENT

Hereinafter, embodiments of the present disclosure will be described in detail with reference to the accompanying drawings so that those with ordinary skill in the art to which the present disclosure pertains will easily be able to implement the present disclosure.

The following detailed description is provided to assist the reader in gaining a comprehensive understanding of the methods, apparatuses, and/or systems described herein. However, various changes, modifications, and equivalents of the methods, apparatuses, and/or systems described herein will be apparent after an understanding of the disclosure of this application. For example, the sequences of operations described herein are merely examples, and are not limited to those set forth herein, but may be changed as will be apparent after an understanding of the disclosure of this application, with the exception of operations necessarily occurring in a certain order. Also, descriptions of features that are known in the art may be omitted for increased clarity and conciseness.

Throughout the present disclosure, when a part is said to be "connected" with the other part, it not only includes a case that the part is "directly connected" to the other part, but also includes a case that the part is "electrically connected" to the other part with another element being interposed therebetween.

Throughout the present disclosure, when any member is positioned "on", "over", "above", "beneath", "under", and "below" the other member, this not only includes a case that the any member is brought into contact with the other member, but also includes a case that another member exists between two members.

Throughout the present disclosure, if a prescribed part "includes" a prescribed element, this means that another element can be further included instead of excluding other elements unless any particularly opposite description exists.

When unique manufacture and material allowable errors of numerical values are suggested to mentioned meanings of terms of degrees used in the present specification such as "about", "substantially", etc., the terms of degrees are used in the numerical values or as a meaning near the numerical values, and the terms of degrees are used to prevent that an unscrupulous infringer unfairly uses a disclosure content, in which exact or absolute numerical values are mentioned to help understanding of the present disclosure. Further, in the whole specification of the present disclosure, "a step to do~" or "a step of~" does not mean "a step for~".

Throughout the present disclosure, a term of "a combination thereof" included in a Markush type expression, which means a mixture or combination of one or more selected from the group consisting of constituent elements described in the Markush type expression, means including one or more selected from the group consisting of the constituent elements.

Throughout the present disclosure, the description of "A and/or B" means "A, B, or A and B".

The terminology used herein is for describing various examples only, and is not to be used to limit the disclosure. The articles "a," "an," and "the" are intended to include the plural forms as well, unless the context clearly indicates otherwise. The terms "comprises," "includes," "has," and "contains" specify the presence of stated features, numbers, operations, members, elements, and/or combinations thereof, but do not preclude the presence or addition of one or more other features, numbers, operations, members, elements, and/or combinations thereof.

Hereinafter, a water splitting catalyst of the present disclosure will be described in detail with reference to embodiments, examples, and drawings. However, the present disclosure is not limited to such embodiments, examples, and drawings.

The present disclosure is to solve the aforementioned problems of the conventional art, and an object of the present disclosure is to provide a water splitting catalyst and a method for preparing the same.

Further, the other object of the present disclosure is to provide a water splitting system including the water splitting catalyst.

As a technical means for achieving the above-mentioned technical tasks, the first aspect of the present disclosure provides a water splitting catalyst including a porous carbon layer, a bimetallic metal alloy core dispersed on the porous carbon layer, and a single-atom precious metal dispersed on the bimetallic metal alloy core, in which oxygen is adsorbed on the surface of the bimetallic metal alloy core.

FIG. 1 is a schematic diagram of a water splitting catalyst according to an embodiment of the present disclosure. Specifically, FIG. 1 is about a bimetallic metal alloy core dispersed on a porous carbon layer, and FIG. 1 discloses an alloy core of Fe and Co, which is existed in a state that an Ru single-atom precious metal is dispersed on the surface thereof, and oxygen is adsorbed thereon. However, other precious metals may be used instead of Ru, and metal alloys other than those of Fe and Co may be used.

In general, a water splitting catalyst refers to a catalyst for accelerating a reaction, in which water ($H_2O$) is split into oxygen ($O_2$) and hydrogen ($H_2$). In this regard, the water splitting catalyst according to the present disclosure is for splitting water to form oxygen, and may be used in a reduction electrode in a water splitting system to be described later.

In the present disclosure, single-atom precious metals mean one, in which the precious metal atoms are not agglomerated with each other unlike nanoparticles or the like, and exist in the form of single atoms. Such single-atom precious metals are being studied as novel catalysts as they provide 100% atomic utilization and exhibit superior catalytic activities compared to metal nanoparticles.

A single-atom precious metal according to the present disclosure is one, in which one atom of the precious metal is dispersed in the bimetallic metal alloy core, and may function as a catalyst of an oxygen evolution reaction. In this regard, when the precious metal exists in the form of nanoparticles, that is, in the form of agglomerated single atoms, the water splitting catalyst may also be used as a catalyst for a hydrogen evolution reaction.

According to an embodiment of the present disclosure, oxygen formed on the surface of the bimetallic metal alloy core may stabilize an intermediate material of the water splitting reaction, but the present disclosure is not limited thereto.

Specifically, the water splitting reaction may be divided into an oxygen evolution reaction and a hydrogen evolution reaction, and the oxygen evolution reaction may include a reaction according to the reaction formula below.

[Reaction Formula]

$$2H_2O \rightarrow HO^* + H_2O + H^+ + e^- \rightarrow O^*H_2O + 2H^+ + 2e^- \rightarrow HOO^* + 3H^+ + 3e^- \rightarrow O_2 + 4H^+ + 4e^-$$

Conventional catalysts used in an oxygen evolution reaction could not stabilize the $HOO^*$ intermediate, and a large amount of energy was required for the reaction, in which $O^*$ became $HOO^*$ so that a large amount of energy was required to generate oxygen. However, the water splitting catalyst according to the present disclosure may have better performance than the conventional catalysts for the oxygen evolution reaction by allowing a single-atom precious metal to reduce the kinetic energy barrier of the reaction, in which $O^*$ becomes $HOO^*$, and enabling the $HOO^*$ intermediate to be stabilized through adsorbed oxygen present on the surface of the catalyst at the same time.

According to an embodiment of the present disclosure, the water splitting catalyst may further include an additional oxygen formed on the surface of the porous carbon layer, but the present disclosure is not limited thereto.

The water splitting catalyst according to the present disclosure may include oxygen ($O_{lattice}$) adsorbed on the surface of the bimetallic metal alloy core and oxygen ($O_{substrate}$) formed on the surface of the porous carbon layer.

Oxygen formed on the surface of the porous carbon layer is one, in which the porous carbon layer is doped with a heteroatom, and may improve the water splitting reaction rate by increasing conductivity of the porous carbon layer, thereby increasing mobility of electrons.

According to an embodiment of the present disclosure, the water splitting catalyst may include 0.01 to 0.8 atomic parts of a single-atom precious metal, 1 to 7 atomic parts of oxygen adsorbed on a bimetallic metal alloy core, and 1 to 20 atomic parts of oxygen formed on the surface of the porous carbon layer, with respect to 100 atomic parts of the water splitting catalyst, but the present disclosure is not limited thereto.

As will be described later, in the process of etching the water splitting catalyst, the ratio of oxygen formed on the surface of the porous carbon layer may decrease so that the ratio of oxygen adsorbed on the bimetallic metal alloy core may increase.

According to an embodiment of the present disclosure, the porous carbon layer may contain graphene having defects, but the present disclosure is not limited thereto. At this time, the graphene is one, in which carbons form a two-dimensional planar structure, and may include graphene oxide or reduced-graphene oxide.

According to an embodiment of the present disclosure, the defects may include any one or more point defects of vacancy, interstitial atom, and substitutional atom, but the present disclosure is not limited thereto.

The bimetallic metal alloy core of the water splitting catalyst may be present at a location of defects dispersed on the porous carbon layer, but the present disclosure is not limited thereto.

When the bimetallic metal alloy core is not present at the location of the defects dispersed on the porous carbon layer, the degree of contact between the electrolyte, which is a reaction target of the water splitting reaction, and the active site of the single-atom precious metal is reduced or eliminated so that the water splitting reaction may be limitedly performed.

According to an embodiment of the present disclosure, two metals contained in the bimetallic metal alloy core may have an atomic composition ratio of 0.25:1 to 4:1, but the present disclosure is not limited thereto. For example, the two metals contained in the bimetallic metal alloy core may have an atomic composition ratio of about 0.25 : 1 to 4:1, about 0.5:1 to 4:1, about 0.75:1 to 4:1, about 1:1 to 4:1, about 1.25:1 to 4:1, about 1.5:1 to 4:1, about 1.75:1 to 4:1, about 2:1 to 4:1, about 2.25:1 to 4:1, about 2.5:1 to 4:1, about 2.75:1 to 4:1, about 3:1 to 4:1, about 3.25:1 to 4:1, about 3.5:1 to 4:1, about 3.75:1 to 4:1, about 0.25:1 to 0.5:1, about 0.25:1 to 0.75:1, about 0.25:1 to 1:1, about 0.25:1 to 1.25:1, about 0.25:1 to 1.5:1, about 0.25:1 to 1.75:1, about 0.25:1 to 2:1, about 0.25:1 to 2.25:1, about 0.25:1 to 2.5:1, about 0.25:1 to 2.75:1, about 0.25:1 to 3:1, about 0.25:1 to 3.25:1, about 0.25:1 to 3.5:1, about 0.25:1 to 3.75:1, about 0.5:1 to 3.75:1, about 0.75:1 to 3.5:1, about 1:1 to 3.25:1, about 1.25:1 to 3:1, about 1.5:1 to 2.75:1, about 1.75:1 to 2.5:1, about 2:1 to 2.25:1, or about 0.5:1 to 2:1, but the present disclosure is not limited thereto.

The bimetallic metal alloy core is a support of the single-atom precious metal, and may prevent the single-atom precious metals from bonding to each other, may have oxygen adsorbed on the surface thereof, and may supply electrons necessary for the water splitting reaction or collect generated electrons.

According to an embodiment of the present disclosure, the bimetallic metal alloy core may include two metal elements selected from the group consisting of Fe, Co, Cu, Zn, Ni, Mn, Cr, Ti, Y, Zr, Nb, and Mo, but the present disclosure is not limited thereto. Preferably, the bimetallic metal alloy core may be an alloy of Fe and Co.

According to an embodiment of the present disclosure, the precious metal may include one selected from the group consisting of Ru, Ir, Rh, Pd, Ag, Au, Pt, and combinations thereof, but the present disclosure is not limited thereto.

According to an embodiment of the present disclosure, the water splitting catalyst may require an overpotential of 100 to 250 mV in order to achieve a current density of 10 $mA/cm^2$, but the present disclosure is not limited thereto. For example, the water splitting catalyst may require an overpotential of about 100 to 250 mV, about 125 to 250 mV, about 150 to 250 mV, about 175 to 250 mV, about 200 to 250 mV, about 225 to 250 mV, about 100 to 125 mV, about 100 to 150 mV, about 100 to 175 mV, about 100 to 200 mV, about 100 to 225 mV, about 125 to 225 mV, about 150 to 200 mV, or about 175 mV in order to achieve a current density of 10 $mA/cm^2$, but the present disclosure is not limited thereto.

At this time, the current density may be an index indicating the performance of the water splitting catalyst.

The conventional water splitting catalyst requires an overpotential of at least 298 mV in order to achieve a current density of 10 $mA/cm^2$. However, since a water splitting catalyst according to the present disclosure only requires an overpotential of 180 mV, the power required to produce oxygen may be reduced when the water splitting catalyst according to the present disclosure is used.

According to an embodiment of the present disclosure, the water splitting catalyst may have a Tafel slope of 40 to 70 mV/dec, but the present disclosure is not limited thereto.

Furthermore, the second aspect of the present disclosure provides a method for preparing a water splitting catalyst, the method includes the steps of forming a mixed solution containing a metal-polymer micelle ($M_1M_2$-micelles) by mixing a first metal precursor, a second metal precursor, and a polymer solution, forming an intermediate, in which a precious metal is formed on the surface of the metal-polymer micelle by injecting a precious metal precursor into the mixed solution, and heat-treating the intermediate.

With respect to the method for preparing a water splitting catalyst according to the second aspect of the present disclosure, detailed descriptions of parts overlapping with the first aspect of the present disclosure have been omitted, but even if the descriptions have been omitted, the contents described in the first aspect of the present disclosure may be equally applied to the second aspect of the present disclosure.

FIG. 2 is a flowchart illustrating a method for preparing a water splitting catalyst according to an embodiment of the present disclosure, and FIG. 3 is a schematic diagram showing a method for preparing a water splitting catalyst according to an embodiment of the present disclosure. Specifically, FIG. 3 means a method for preparing a water splitting catalyst when the first metal and the second metal are Fe and Co, and the precious metal is Ru.

In this regard, the first metal and the second metal refer to two metal elements forming the bimetallic metal alloy core of the water splitting catalyst.

First, a first metal precursor, a second metal precursor, and a polymer solution are mixed to form a mixed solution containing a metal-polymer micelle ($M_1M_2$-micelles) (S100).

According to an embodiment of the present disclosure, the polymer solution may include a polymer selected from the group consisting of polystyrene (PS), polyethylene glycol (PEG), polylactic acid (PLA), polypropylene glycol (PPG), and combinations thereof, but the present disclosure is not limited thereto. For example, the polymer solution may include F-127 polymer of PEG-PPG-PEG structure and/or PS.

The polymer solution may include an amphiphilic polymer, but the present disclosure is not limited thereto. The amphiphilic polymer may serve as a surfactant in the mixed solution.

According to an embodiment of the present disclosure, the metal-polymer micelle may include a bimetallic metal alloy core including two metal elements and a polymer dispersed on the bimetallic metal alloy core, but the present disclosure is not limited thereto. In this regard, the bimetallic metal alloy core of the metal-polymer micelle may have a form, in which ions of the metal elements or metal particles are agglomerated, unlike the bimetallic metal alloy core of the water splitting catalyst according to the first aspect.

Referring to FIG. 3, the first metal ion and the second metal ion of the first metal precursor and the second metal precursor added to the polymer solution are bonded to each other in the mixed solution so that a bimetallic metal alloy core may be formed. At this time, the amphiphilic polymer of the polymer solution is bonded to the surface of the bimetallic metal alloy core so that the metal-polymer micelle may be formed, in which the hydrophobic region of the polymer is bonded to the bimetallic metal alloy core and the hydrophilic region of the polymer is in contact with a solvent (for example, water) of the mixed solution.

According to an embodiment of the present disclosure, the polymer solution may have a pH of 8 to 11, but the present disclosure is not limited thereto. For example, the polymer solution may have a pH of about 8 to 11, about 8.5 to 11, about 9 to 11, about 9.5 to 11, about 10 to 11, about 10.5 to 11, about 8 to 8.5, about 8 to 9, about 8 to 9.5, about 8 to 10, about 8 to 10.5, about 8.5 to 10.5, about 9 to 10, or about 9.5, but the present disclosure is not limited thereto.

According to an embodiment of the present disclosure, the first metal precursor and the second metal precursor may each independently include a metal element selected from the group consisting of Fe, Co, Cu, Zn, Ni, Mn, Cr, Ti, Y, Zr, Nb, and Mo, and the first metal and the second metal may be different metal elements, but the present disclosure is not limited thereto.

Subsequently, precious metal precursors are injected into the mixed solution to form an intermediate, in which precious metals are formed on the surface of the metal-polymer micelles (S200).

According to an embodiment of the present disclosure, the precious metal precursor may include one selected from the group consisting of Ru, Ir, Rh, Pd, Ag, Au, Pt, and combinations thereof, but the present disclosure is not limited thereto.

The intermediate means one, in which the precious metal is attached in the form of a single atom on the surface of the metal-polymer micelle. At this time, since the metal-polymer micelle is bonded to each Ru atom, the precious metal is not agglomerated in the form of nanoparticles, but is combined with the bimetallic metal alloy core of the metal-polymer micelle so that it may be stabilized in the form of a single atom.

Subsequently, the intermediates are heat-treated (S300).

According to an embodiment of the present disclosure, the method may further include a step of self-assembling the intermediates before heat-treating the intermediates, but the present disclosure is not limited thereto.

Since the intermediates have a form of micelles having precious metals attached to the surface thereof and including a polymer, the intermediates may be self-assembled under specific temperature conditions.

According to an embodiment of the present disclosure, in the step of heat-treating the intermediates, the polymer of the intermediates may form a porous carbon layer, but the present disclosure is not limited thereto.

In this regard, when heat is applied to the polymer composing the intermediates, oxygen of the polymer escapes and the polymer is reduced to a porous carbon layer made of only carbon, and at this time, metal elements or metal particles of the bimetallic metal alloy core of the metal-polymer micelles may be reduced to a metal alloy by the moving electrons.

At this time, oxygen escaped from the polymer may be adsorbed on the surface of the metal alloy.

According to an embodiment of the present disclosure, the porous carbon layer may include a defect, but the present disclosure is not limited thereto.

According to an embodiment of the present disclosure, the bimetallic metal alloy core may be formed at a defect position of the porous carbon layer, but the present disclosure is not limited thereto.

According to an embodiment of the present disclosure, the heat treatment step may be performed in an inert gas atmosphere and at a condition of 600 to 900° C., but the present disclosure is not limited thereto. For example, the heat treatment step may be performed in an inert gas atmosphere and at a condition of about 600 to 900° C., about 650 to 900° C., about 700 to 900° C., about 750 to 900° C., about 800 to 900° C., about 850 to 900° C., about 600 to 650° C., about 600 to 700° C., about 600 to 750° C., about 600 to 800° C., about 600 to 850° C., about 650 to 850° C., about 700 to 800° C., or about 750° C., but the present disclosure is not limited thereto.

According to an embodiment of the present disclosure, the heat treatment step may be performed for 1 to 7 hours, but the present disclosure is not limited thereto. For example, the heat treatment step may be performed for about 1 to 7 hours, about 2 to 7 hours, about 3 to 7 hours, about 4 to 7 hours, about 5 to 7 hours, about 6 to 7 hours, about 1 to 2 hours, about 1 to 3 hours, about 1 to 4 hours, about 1 to 5 hours, about 1 to 6 hours, about 2 to 6 hours, about 3 to 5 hours, or about 4 hours, but the present disclosure is not limited thereto.

When the step of heat-treating the intermediates in an inert gas atmosphere and at a condition of 750° C. is performed for 4 hours, the amount of surface oxygen optimized for the water splitting catalyst may be obtained, and the amount of surface oxygen increases when the time for performing the heat treatment step is reduced to 2 hours or less, and the amount of surface oxygen may be reduced to the minimum when the intermediates are heat-treated together with hydrogen gas.

According to an embodiment of the present disclosure, the method for preparing the water splitting catalyst may further include a step of performing etching with an inert gas before or after performing the heat treatment step, but the present disclosure is not limited thereto.

Furthermore, the third aspect of the present disclosure provides a water splitting system including the water splitting catalyst according to the first aspect.

FIG. 4 is a schematic diagram of a water splitting system according to an embodiment of the present disclosure. Specifically, FIG. 4 shows a water splitting system, in which hydrogen is formed at a $Ni_4Mo$ electrode and oxygen is formed at a $Ru_{SA}CoFe_2/G$ electrode, which is a water splitting catalyst according to the present disclosure.

According to an embodiment of the present disclosure, the water splitting catalyst may be a catalyst for an oxygen evolution reaction or a hydrogen evolution reaction, but the present disclosure is not limited thereto.

The water splitting catalyst according to the first aspect includes a bimetallic metal alloy core having a single-atom precious metal formed on the surface thereof, and an oxygen evolution reaction may be promoted by the single-atom precious metal. In this regard, when the precious metal formed on the surface of the bimetallic metal alloy core has the form of nanoparticles, the water splitting catalyst including the precious metal nanoparticles may be used as a catalyst for a hydrogen evolution reaction.

According to an embodiment of the present disclosure, the water splitting system may split basic water or acidic water, but the present disclosure is not limited thereto.

Hereinafter, the present disclosure will be described in more detail through Examples, but the following Examples are for purpose of explanation only and are not intended to limit the scope of the present disclosure.

EXAMPLE 100 mg of F127 block copolymer and 10 ml of polystyrene (PS) solution (0.5% by weight in ethanol) were dissolved in 20 ml of tetrahydrofuran (THF). Subsequently, 1

M NaOH was slowly dropped into the solution to adjust the pH of the solution to 9 to 10.

Subsequently, a Co precursor and an Fe precursor (in ethanol) were injected into the solution to form a CoFe metal sol. After injecting a Ru precursor into the CoFe metal sol, and slowly evaporating the mixed solution at room temperature to evaporate the THF solvent and the ethanol solvent while performing self-assembling, $Ru_{SA}CoFe_2/G$, $Ru_{SA}Co_2Fe/G$, $Ru_{NP}CoFe_2/G$, $Ru_{NP}Co_2Fe/G$, etc., were formed by performing a thermal carbon reduction method in an Ar atmosphere at 750° C. for 4 hours (Examples 1 to 5).

At this time, whether Ru becomes a form of a single atom (SA) or a form of nanoparticles (NP) may be determined depending on the mass of the Ru precursor injected.

In this regard, the results of EDX analysis of the formed materials are as shown in Table 1 below.

TABLE 1

| | | EDX | | | | | | |
|---|---|---|---|---|---|---|---|---|
| | | C | Co | Fe | O | Ru | Co:Fe | |
| Classification | Sample | (at. %) | (at. %) | (at. %) | (at. %) | (at. %) | Expt. | Obser. |
| Example 1 | $Ru_{SA}CoFe_2/G$ | 68.81 | 8.63 | 17.55 | 3.7 | 0.41 | 1:2 | 1:2 |
| Example 2 | $Ru_{SA}CoFe/G$ | 75.53 | 9.52 | 10.29 | 4.19 | 0.47 | 1:1 | 1:1.1 |
| Example 3 | $Ru_{SA}Co_2Fe/G$ | 70.23 | 16.24 | 8.88 | 4.4 | 0.44 | 2:1 | 1.8:1 |
| Example 4 | $Ru_{NP}CoFe_2/G$ | 73.06 | 6.68 | 12.88 | 6.55 | 0.83 | 1:2 | 1:1.9 |
| Example 5 | $Ru_{NP}Co_2Fe/G$ | 69.82 | 16.82 | 8.52 | 3.95 | 0.89 | 2:1 | 1.97:1 |

In Table 1 above, Examples 1 to 3 are examples, in which Ru is attached to a Co—Fe metal alloy in the form of a single atom, and Examples 4 and 5 are examples, in which Ru is attached to a Co—Fe metal alloy in the form of nanoparticles.

Comparative Example 1

In the process of Example 1 above, CoFe/G, $Co_2Fe/G$, or $CoFe_2/G$ was formed since the process of injecting the Ru precursor was not performed.

Comparative Example 2

$Co(NO_3)_2.6H_2O$ and $Fe(NO_3)_2.9H_2O$ (Co:Fe=1:2) were dissolved in 40 ml of DI water. Subsequently, DI water containing Co and Fe and 40 ml of an aqueous solution containing 3 mmol of $Na_2CO_3$ and 21 mmol of NaOH were dropped to 4 mg of a precursor $RuCl_3.3H_2O$ in a beaker containing 80 ml of distilled water until the pH of both solutions became 8.5. After stirring the mixed solution for one day, the solid dark brown precipitate was settled, washed with water and ethanol, and vacuum dried in an oven at 70° C. to prepare a $Ru_{SA}CoFe_2$-LDH nanosheet.

Comparative Example 3

As a conventional water splitting catalyst, h-$NiS_x$, FeNi/RGO LDH, Ru/CoFe-LDH, Cu@Ni—Fe-LDH, and the like were used.

Experimental Example 1

The water splitting catalysts according to Examples above were analyzed by an electron microscope, XRD, EDX, and the like.

FIG. 5 is an X-ray diffraction (XRD) graph of a water splitting catalyst according to an example of the present disclosure, FIGS. 6A to 6C are transmission electron microscope (TEM) images of a water splitting catalyst according to an example of the present disclosure, FIGS. 6D and 6E are high-angle annular dark-field scanning transmission electron microscopy (HAADF-STEM) images, FIG. 6F is the profiles of the line scan intensities for sites 1 and 2 of FIG. 6E, FIG. 7 is TEM images of a water splitting catalyst according to an example of the present disclosure, and FIG. 8 is scanning electron microscopy with energy-dispersive X-ray spectroscopy (SEM-EDX) elemental analysis images of a water splitting catalyst according to an example of the present disclosure.

Referring to FIGS. 5 to 8, $Ru_{SA}CoFe_2/G$ has an XRD peak similar to that of $CoFe_2/G$. Further, unlike $Ru_{Np}CoFe_2/G$, since peaks ((100), (002), (101), etc.) by Ru do not appear, and Ru exists in the form of individual dots without being agglomerated on the EDX analysis image, it can be seen from $Ru_{SA}CoFe_2/G$ according to Examples above that Ru is attached to the surface of $CoFe_2/G$ in the form of a single atom.

Further, in $Ru_{SA}CoFe_2/G$ above, the surface of the metal alloy ($CoFe_2$) is a surface that has been activated by being exposed to the outside, and oxygen may be formed on the surface of $Ru_{SA}CoFe_2/G$ above.

Experimental Example 2

FIGS. 9A to 9C and FIGS. 10A to 10E are X-ray photoelectron spectroscopy (XPS) spectra of water splitting catalysts according to an example and a comparative example of the present disclosure. In this regard, the Ar etching process performed in FIGS. 9A to 9C and 10A to 10E is to confirm whether or not oxygen is present on the surface of the bimetallic metal alloy core (Co—Fe alloy) of the water splitting catalyst.

Referring to FIGS. 9A to 9C and 10A to 10E, it can be confirmed through the Ar etching process that oxygen is present on the surface of the water splitting catalyst by checking that oxygen ($O_{substrate}$) presenting in the porous carbon layer G is decreased, and oxygen ($O_{lattice}$) presenting on the surface of the bimetallic metal alloy core (Co—Fe alloy) is increased.

Experimental Example 3

FIGS. 11A to 11C are X-ray absorption near edge structure (XANES) spectra of the water splitting catalysts according to the example and comparative example, FIGS. 12A to 12C are extended X-ray absorption fine structure (EXAFS) spectra of the water splitting catalysts according to the example and comparative example, FIG. 13 is wavelet transform of extended X-ray absorption fine structure (WT-EXAFS) images of the water splitting catalyst according to the example, and FIG. 14 is EXAFS fitting curves of the water splitting catalysts according to the example and comparative example.

Referring to FIGS. 11A to 14, in the water splitting catalyst $Ru_{SA}CoFe_2/G$ according to the example, XANES spectra similar to CoFe/G and a Ru—Co/Fe bond are seen, but a Ru—Ru bond is not confirmed. Therefore, it can be confirmed that the Ru particles of $Ru_{SA}CoFe_2/G$ above exist in the form of single atoms without being agglomerated.

Experimental Example 4

FIGS. 15A to 15E are graphs for the oxygen evolution reactions of the water splitting catalysts according to the example and comparative example. Specifically, FIG. 15A is the OER polarization curves of the water splitting catalysts according to the example and comparative example, FIG. 15B is overpotentials required for the water splitting catalysts according to the example and comparative example to reach 10 $mA/cm^2$, FIG. 15C is for the activities of the intrinsic catalysts for OER, FIG. 15D is Tafel plots of the water splitting catalysts according to the example and comparative example, and FIG. 15E is a graph showing the potential differences according to time of the water splitting catalysts according to the example and comparative example in a 1 M KOH electrolyte with a current density of 50 $mA/cm^2$ for 25 hours. More specifically, the graph inserted on the left in FIG. 15E is the amount of oxygen gas and Faraday efficiency obtained by the water splitting catalyst according to the example in 1 M KOH, and the graph inserted on the right in FIG. 15E is the LSV curves before and after the stability test.

Referring to FIGS. 15A to 15E, the $Ru_{SA}CoFe_2/G$ can achieve a high current density even at a low voltage compared to other conventional catalysts ($RuO_2$, $CoFe_2/G$, 5% Ru/C, or Ni foam), has a low slope of the Tafel curve, and has a low applied voltage even if it is used for a long period of time. Further, the $Ru_{SA}CoFe_2/G$ is stable compared to the conventional catalyst, such as a Faraday efficiency of about 97.4% and the amount of oxygen gas obtained being stable while linearly increasing with time, and it can reduce the electrical energy required for oxygen generation.

Experimental Example 5

FIGS. 16A and 16B are graphs showing the water splitting capacities of the water splitting catalysts according to the example and comparative example, and FIG. 17 is a graph showing the durabilities of the water splitting systems according to the example and comparative example, and FIG. 18 is a graph showing the durability of the water splitting system according to the example. At this time, the inserted graphs of FIGS. 17 and 18 are the LSV curves before and after the stability test.

Referring to FIGS. 16A to 18, it can be confirmed that the water splitting system including $Ni_4Mo//Ru_{SA}CoFe_2/G$ requires less electrical energy compared to the conventional water splitting system, and has a lifespan of 100 hours, which is more than twice that of the conventional Pt/C//$RuO_2$ water splitting system.

According to the above-described means for solving the problems of the present disclosure, the water splitting catalyst according to the present disclosure may lower the energy barrier of the rate determining step (the step in which $O^*$ becomes $HOO^*$ of the oxygen evolution reaction through a single-atom precious metal, and may stabilize $HOO^*$ intermediates through oxygen adsorbed on the surface. Accordingly, the water splitting catalyst may produce oxygen by using less energy than a conventional catalyst for an oxygen evolution reaction.

Further, a water splitting catalyst according to the present disclosure may be able to be used also in a hydrogen evolution reaction by changing a single-atom precious metal into a nanoparticle precious metal.

Further, a water splitting catalyst according to the present disclosure may be excellent in durability and oxygen evolution efficiency since there is not a change in the voltage of a battery even when using the water splitting catalyst according to the present disclosure for 100 hours or more, and more oxygen can be formed compared to a conventional water splitting catalyst when the same voltage is applied.

Further, a method for preparing a water splitting catalyst according to the present disclosure may prepare a water splitting catalyst in an inexpensive manner since the use amount of a precious metal is less than that of a conventional method for preparing a water splitting catalyst.

However, the effects obtainable from the present disclosure are not limited to the above-described effects, and other effects may exist.

The foregoing description of the present disclosure is for illustration, and those with ordinary skill in the art to which the present disclosure pertains will understand that it can be easily modified into other specific forms without changing the technical spirit or essential features of the present disclosure. Therefore, it should be understood that the embodiments described above are illustrative in all aspects and not restrictive. For example, each constituent element described as a single type may be implemented in a distributed manner, and likewise constituent elements described as distributed may also be implemented in a combined form.

The scope of the present disclosure is indicated by the claims to be described later rather than the above-detailed description, and all changed or modified forms derived from the meaning and scope of the claims and equivalent concepts thereof should be construed as being included in the scope of the present disclosure.

What is claimed is:

1. A water splitting catalyst comprising:

a porous carbon layer;

a Co—Fe bimetallic metal alloy core dispersed on the porous carbon layer; and a single atomic Ru dispersed on the Co—Fe bimetallic metal alloy core, wherein an oxygen is adsorbed on a surface of the Co—Fe bimetallic metal alloy core, and wherein the water splitting catalyst comprises 0.1 to 0.47 atomic parts of the single atomic Ru based on 100 atomic parts of the water splitting catalyst.

2. The water splitting catalyst of claim 1, wherein the oxygen stabilizes an intermediate material of a water splitting reaction.

3. The water splitting catalyst of claim 1, further comprising an additional oxygen disposed on a surface of the porous carbon layer.

4. The water splitting catalyst of claim 1, wherein the porous carbon layer comprises a graphene having defects.

5. The water splitting catalyst of claim 1, wherein the Co—Fe bimetallic metal alloy core comprises Co and Fe and an atomic composition ratio of the Co and Fe is 0.25:1 to 4:1.

6. The water splitting catalyst of claim 1, wherein the water splitting catalyst comprises 1 to 7 atomic parts of the oxygen adsorbed on the surface of the Co—Fe bimetallic metal alloy core based on 100 atomic parts of the water splitting catalyst.

7. The water splitting catalyst of claim 3, wherein the water splitting catalyst comprises 1 to 20 atomic parts of the additional oxygen disposed on the surface of the porous carbon layer based on 100 atomic parts of the water splitting catalyst.

8. The water splitting catalyst of claim 1, wherein the water splitting catalyst requires an overpotential of 100 to 250 mV to achieve a current density of 10 $mA/cm^2$.

9. The water splitting catalyst of claim 1, wherein the water splitting catalyst has a Tafel slope of 40 to 70 mV/dec.

10. A water splitting system comprising the water splitting catalyst according to claim 1.

11. A method for preparing the water splitting catalyst of claim 1 comprising:

forming a mixed solution comprising a metal-polymer micelle ($M_1M_2$-micelle) by mixing a Co precursor, a Fe precursor, and a polymer solution;

forming an intermediate, in which the single atomic Ru is disposed on a surface of the metal-polymer micelle by injecting a Ru precursor into the mixed solution; and heat-treating the intermediate, wherein the water splitting catalyst comprises 0.1 to 0.47 atomic parts of the single atomic Ru based on 100 atomic parts of the water splitting catalyst.

12. The method of claim 11, further comprising self-assembling the intermediate before the heat-treating.

13. The method of claim 11, wherein the metal-polymer micelle comprises the Co—Fe bimetallic metal alloy core comprising Co and Fe and a polymer dispersed on a surface of the bimetallic metal alloy core.

14. The method of claim 11, wherein in the heat-treating, the polymer of the intermediate forms the porous carbon layer.

15. The method of claim 11, wherein the polymer solution comprises a polymer selected from the group consisting of polystyrene (PS), polyethylene glycol (PEG), polypropylene glycol (PPG), polylactic acid (PLA), and combinations thereof.

16. The method of claim 11, wherein the polymer solution has a pH of 8 to 11.

17. The water splitting system of claim 10, wherein the water splitting catalyst is a catalyst for an oxygen evolution reaction or a hydrogen evolution reaction.

* * * * *